US010814198B2

(12) United States Patent
Ling

(10) Patent No.: US 10,814,198 B2
(45) Date of Patent: Oct. 27, 2020

(54) SYSTEM FOR DOWNING A BALL CARRIER AND FOR TACKLE TRAINING

(71) Applicant: TackleBar, LLC, St. Paul, MN (US)

(72) Inventor: Jeremy J. Ling, St. Paul, MN (US)

(73) Assignee: TackleBar, LLC, St. Paul, MN (US)

( * ) Notice: Subject to any disclaimer, the term of this patent is extended or adjusted under 35 U.S.C. 154(b) by 0 days.

(21) Appl. No.: 16/257,387

(22) Filed: Jan. 25, 2019

(65) Prior Publication Data

US 2019/0232137 A1 Aug. 1, 2019

Related U.S. Application Data

(60) Provisional application No. 62/622,278, filed on Jan. 26, 2018.

(51) Int. Cl.
*A63B 69/00* (2006.01)
*A63B 71/00* (2006.01)
(Continued)

(52) U.S. Cl.
CPC ..... *A63B 69/002* (2013.01); *A63B 69/00* (2013.01); *A63B 69/0059* (2013.01);
(Continued)

(58) Field of Classification Search
CPC . A63B 69/00; A63B 2243/007; A63B 67/002; A63B 71/0605; A63B 71/068;
(Continued)

(56) References Cited

U.S. PATENT DOCUMENTS 1,092,792 A * 4/1914 Hemstreet ..... A45F 3/14 242/136
2,978,197 A * 4/1961 Anderson ..... A47K 10/38 242/596.5

(Continued)

FOREIGN PATENT DOCUMENTS

DE 10048149 4/2002
WO 9402040 A1 2/1994

OTHER PUBLICATIONS

International Search Report and Written Opinion for Application No. PCT/US2019/015231 dated May 17, 2019.

(Continued)

*Primary Examiner* — Mitra Aryanpour
(74) *Attorney, Agent, or Firm* — Merchant & Gould P.C.

(57) ABSTRACT

A tackle training system defines a frame configured for attachment to a player's body. The frame has an upper portion, a lower portion, and a center portion extending therebetween. The upper portion defines at least one attachment structure extending downwardly toward the lower portion, and the lower portion defines at least one attachment structure extending upwardly toward the upper portion generally vertically aligned with the attachment structure of the upper portion. The opposing attachment structures are for contacting opposing ends of a bar so as to removably attach and extend the bar between the upper and lower portions. The attachment structures of the frame limit movement of the removable bar generally to that of the frame and allow release of the removable bar from the frame when a force that overcomes an attachment force provided by the attachment structures is applied to the removable bar.

19 Claims, 25 Drawing Sheets

(51) Int. Cl.
*A63B 71/06* (2006.01)
*A63B 69/34* (2006.01)

(52) U.S. Cl.
CPC ..... *A63B 69/345* (2013.01); *A63B 71/0605* (2013.01); *A63B 71/0608* (2013.01); *A63B 71/0622* (2013.01); *A63B 2071/0625* (2013.01); *A63B 2071/0694* (2013.01); *A63B 2207/02* (2013.01); *A63B 2209/10* (2013.01); *A63B 2243/007* (2013.01)

(58) Field of Classification Search
CPC .... A63B 47/001; A63B 69/345; A63B 69/003
USPC ..... 473/502, 438, 422, 450, 458, 464; 242/596.1–596.8, 34, 47; 206/390, 391, 206/408, 493
See application file for complete search history.

(56) References Cited

U.S. PATENT DOCUMENTS 3,088,686 A * 5/1963 Curry ..... A47K 10/40 242/596.1
3,160,361 A * 12/1964 Monahan ..... A47K 10/405 242/596.3
3,239,156 A * 3/1966 Castellano ..... A47K 10/405 242/596.3
3,319,855 A * 5/1967 Tucker ..... A47K 10/38 225/67
3,335,858 A * 8/1967 Sibille ..... B65D 71/70 206/392
3,484,974 A 12/1969 Culmone
3,623,676 A * 11/1971 Eckels ..... A47K 10/38 242/596.8
3,706,421 A * 12/1972 Popham ..... A47K 10/38 242/596.5
3,721,395 A * 3/1973 Snipes ..... A47K 10/38 242/596.8
3,729,145 A * 4/1973 Koo ..... A47K 10/32 242/596.5
4,033,455 A * 7/1977 Robison ..... B65D 19/06 206/391
4,097,002 A * 6/1978 Krueger ..... A47K 10/40 242/160.1
4,390,096 A * 6/1983 Goldenberg ..... A41D 3/08 2/84
4,433,803 A 2/1984 Liberboim
4,441,211 A 4/1984 Donzis
4,614,312 A * 9/1986 Del Pino ..... A47K 10/40 242/596.4
4,706,860 A 11/1987 Lieider
4,762,288 A * 8/1988 Eckels ..... A47K 10/38 242/422.4
4,852,782 A 8/1989 Wu et al.
D326,580 S * 6/1992 Brazis ..... D6/522
5,727,750 A * 3/1998 Kelly ..... A47K 10/40 242/596.3
5,730,387 A * 3/1998 Yamazaki ..... B65H 19/28 242/532.3
5,938,549 A 8/1999 Schenkenfelder
5,947,352 A 9/1999 Parsons
6,004,232 A 12/1999 Sennott
6,082,664 A * 7/2000 Phelps ..... A47K 10/38 242/560
6,092,759 A * 7/2000 Gemmell ..... A47K 10/38 242/596.2
6,138,939 A * 10/2000 Phelps ..... A47K 10/38 242/596.7
6,158,192 A * 12/2000 Gardner ..... B65B 67/085 156/577
D475,837 S 6/2003 Neider
6,610,032 B1 8/2003 Prody
6,824,031 B2 * 11/2004 McKenzie ..... A45F 3/14 224/666
6,993,940 B2 2/2006 Rabinowicz et al.
7,048,225 B2 * 5/2006 Delfino ..... A47K 10/40 206/229
D551,478 S * 9/2007 Dretzka ..... D6/522
7,392,921 B1 * 7/2008 McKenzie ..... A45F 3/14 224/666
D609,948 S * 2/2010 Seehoff ..... D6/518
7,988,085 B2 * 8/2011 Cattacin ..... A47K 10/38 242/596.7
8,152,659 B1 4/2012 Wadley
D739,158 S * 9/2015 Pan ..... D6/518
9,468,827 B2 10/2016 Ling
D861,996 S * 10/2019 Axelrod ..... D30/130
2005/0153153 A1 7/2005 Saur et al.
2009/0042675 A1 2/2009 Baun, II et al.
2010/0323824 A1 12/2010 Gamboa
2011/0144551 A1 6/2011 Johnson
2014/0298574 A1 10/2014 Williams et al.
2017/0232317 A1 8/2017 Ling

OTHER PUBLICATIONS

Tacklebar Football, TackleBar FootBall [online], retrieved on Apr. 12, 2019, Retrieved from the Internet: <URL: https://www.youtube.com/watch?time_continue=4&v=YSkqbuPZAgs>, Aug. 13, 2017.

* cited by examiner

SYSTEM FOR DOWNING A BALL CARRIER AND FOR TACKLE TRAINING

CROSS-REFERENCE TO RELATED APPLICATION

The present patent application claims the benefit of U.S. Provisional Patent Application Ser. No. 62/622,278, filed Jan. 26, 2018, which application is hereby incorporated by reference in its entirety.

BACKGROUND

Modern research and studies are raising significant concerns over the long-term health consequences that can result from sports concussions and other types of play-related head injuries. As the concerning evidence mounts, American tackle football is one sport that has become the topic of considerable controversy. Dangerous collisions/injuries can happen accidentally in any sports; however, in tackle football the risk factors are significantly higher since collisions are an intentional rather than an accidental part of the game. In a game such as American tackle football, the primary method of downing the ball carrier is by tackling the ball carrier to the ground, which inherently results in collisions. The magnitude and repetition of these collisions can cause concussions and head injury.

Research is showing that it is not always just one large collision that leads to injury, but even repetitive smaller collisions that can make the brain more susceptible to injury over time. This is concerning, since tackle football players experience repetitive collisions as part of the games, practices, and drills. In regards to youth football, there are some further unique concerns. Youngsters are not miniature adults. For starters, their brains are not yet fully myelinated, meaning nerve cells in the brain lack the complete coating that offers protection. This makes youth more susceptible to concussions, and also means they recover more slowly from them compared to adults. Children have big heads relative to the rest of their bodies and weak necks, creating a "bobblehead effect" that elevates the risk of concussion. Kids typically play in the oldest equipment, with the least educated coaches, and with little or no available medical care. And finally, kids are unable to provide meaningful informed consent. Rarely do kids really understand the situations and risks they're putting themselves in.

Flag football is an alternative to tackle football. However, most football enthusiasts would view flag football as an inferior version of the game. In flag football, there is no tackling. Instead, all players wear one or more flags that, when removed from a ball carrier, indicates that the ball carrier is down, thereby signifying the end of that play. The flags are typically flat, narrow strips of nylon or fabric. One end of the flag is normally releasably secured to a belt worn around the player's waist. Hook and loop type fasteners such as VELCRO® are a common means to secure one end of the flag to the player. The other end of the flag hangs freely down toward the player's knees. As the players run, the flag is free to bounce, move, and flutter around (as the name "flag" would suggest). The flag therefore has its own movements independent from the ball carrier. This dynamic, independent motion of the flag makes it difficult to grab the flag even if a player has a good position or grip on the ball carrier. In fact, often it takes a bit of luck to grab the flag. For example, players can be in what is considered a good defensive position to down the ball carrier, but the elusiveness of the flag allows the ball carrier to escape and continue advancing the ball. This attribute makes flag football a unique sport to defend. In tackle football, defensive players are taught to focus on a ball carrier's movements (specifically the torso) when tracking and downing the ball carrier. Many other sports and games similarly share this common ingredient, whereby defense has to watch and interpret movements of opposing players in order to make a defensive stand. Flag football is distinctly unique, in that defensive emphasis is placed on movements of an independently moving flag instead of movements of a player. Many football and sports enthusiasts alike do not care for this non-conventional emphasis.

In flag football, the flags generally attach approximately at the player's waistline, and the flags hang freely down toward the player's knee region. This attachment location is not ideal for head safety. Even though there's no tackling in flag football, the low flag positioning often results in players lowering their heads to make a play for the flag. Any time players are lowering their heads to reach for a flag, it is creating a dangerous situation in terms of head injuries. For example, accidental collisions between a ball carrier's knee and a defender's head can be very dangerous in terms of concussions and head injuries. Positioning flags on the lower body (waist down) is a poor location, as it requires players to lower their body and head to make a play for the flag, which puts players' heads at risk of experiencing collisions.

Furthermore, the flag is a flat strip of fabric, or the like, with very minimal thickness. Flag length is often around 12-16 inches. Flag width is typically around 1.5 inches. And, flag thickness is typically only around 0.062 inches (typical fabric thicknesses). This slim thickness profile along with the fabric type construct can make the flags difficult to distinguish or grab, as they can easily slip out of the defenders' hands. Essentially, flags are not ergonomically designed to be grasped by a hand, as they lack any sort of grab features or dimensions. Therefore, the flag construction and profile further adds to the luck factor in downing the ball carrier. For many American football enthusiasts, the emphasis on a flag rather than a player, combined with the proportion of luck versus skill in downing the ball carrier is unappealing for flag football.

With the growing awareness and evidence associating tackle football with head injuries, concussions, and long-term health implications, there exists a need for alternative ways to down the ball carrier that also promotes proper tackling techniques for a conventional form of the game. Specifically, the alternative means of downing the ball carrier should avoid the physical act of tackling, thereby minimizing collisions associated with head injuries and concussions, while encouraging proper positioning and technique for conventional tackle training. Furthermore, the alternative means should encourage upright play and training, such that players do not have to reach low to down the ball carrier, thereby lowering and exposing their heads to dangerous situations. Furthermore, there exists a need for alternative ways of downing the ball carrier and tackle training systems that reward good defensive positioning for conventional tackling form, and minimizes the luck factor in downing the ball carrier. Furthermore, there exists a need for alternative ways of downing the ball carrier that preserve the conventional defensive focus on a player's movements, rather than arbitrary movements of an accessory such as a flag.

SUMMARY

Generally, the disclosure is directed to a system worn by American football players and players of similar sports, such as Rugby. The system includes a removable component(s), which hereinafter will be referred to as a tackling bar, or simply, a bar. A tackling bar may be an elongated structure configured for attachment to a player's body. The system may also include a belt, harness, or the like, to facilitate removable attachment of the bar(s) to the player's body. Alternatively, the term harness may include or refer to other structures such as jerseys or uniforms and may include attachment provisions for connecting the bar(s) to a player's body. The tackling bar's construction and attachment mechanism are configured to limit independent motion of the bar, thereby constraining the bar to move in unison with the player. This attribute preserves conventional defensive emphasis, requiring defensive focus on movements of the ball carrier, rather than diverting attention to arbitrary, independent movements of an accessory, encouraging proper tackling techniques. When the bar is removed from the ball carrier, this signifies the ball carrier is down and the play is over. Removal of the bar is intended to therefore be an alternative way of downing the ball carrier, thereby avoiding the collisions associated with tackling. The system could be utilized in all the various types of football-like games, including padded, non-padded, and, for example, as an improvement to conventional flag football. The system may also be utilized in sports such as Rugby. The tackling bar may take form in various lengths and shapes, but is generally dimensioned and constructed to be easily graspable and distinguishable when worn on a player's body. As noted above, even though the embodiments discussed herein may refer to ways of downing a ball carrier during a game, it should be noted that the inventive aspects of the embodiments may also be used for tackle training purposes since the inventive systems promote proper technique and positioning in conventional tackle situations.

According to one example aspect, the disclosure is directed to a tackle training system comprising a frame defining an upper portion, a lower portion, and a center portion extending between and connecting the upper portion and the lower portion, the upper portion defining at least one post extending downwardly toward the lower portion, and the lower portion defining at least one post extending upwardly toward the upper portion generally vertically aligned with the at least one post extending from the upper portion, wherein the opposing posts of the upper and lower portions, respectively, are configured for insertion into opposing ends of a bar so as to removably attach and extend the bar between the upper and lower portions of the frame, the posts of the frame configured to limit movement of the removable bar generally to that of the frame, the posts configured to allow release of the removable bar from the frame when a force that overcomes an attachment force provided by the posts is applied to the removable bar and at least one strap attached to the frame to be used for attachment to a player's body. The system also includes at least one bar attached to the frame via the posts so as to extend between the upper and lower portions thereof.

According to another example aspect, the disclosure is directed to a tackle training apparatus that comprises a frame defining an upper portion, a lower portion, and a center portion extending between and connecting the upper portion and the lower portion, the upper portion defining at least one post extending downwardly toward the lower portion, and the lower portion defining at least one post extending upwardly toward the upper portion generally vertically aligned with the at least one post extending from the upper portion, wherein the opposing posts of the upper and lower portions, respectively, are configured for insertion into opposing ends of a bar so as to removably attach and extend the bar between the upper and lower portions of the frame, the posts of the frame configured to limit movement of the removable bar generally to that of the frame, the posts configured to allow release of the removable bar from the frame when a force that overcomes an attachment force provided by the posts is applied to the removable bar, and at least one strap attached to the frame to be used for attachment to a player's body.

According to another example aspect, the disclosure is directed to a tackle training apparatus comprising a frame defining an upper portion and a lower portion, the upper portion defining at least one attachment structure extending downwardly toward the lower portion and the lower portion defining at least one attachment structure extending upwardly toward the upper portion generally vertically aligned with the at least one attachment structure extending from the upper portion, wherein the opposing attachment structures of the upper and lower portions, respectively, are configured for contacting opposing ends of a bar so as to removably attach and extend the bar between the upper and lower portions of the frame, the attachment structures of the frame configured to limit movement of the removable bar generally to that of the frame, the attachment structures configured to allow release of the removable bar from the frame when a force that overcomes an attachment force provided by the attachment structures is applied to the removable bar.

According to yet another aspect, the disclosure is directed to a tackle training apparatus comprising a frame and at least one attachment structure extending from the frame for removably attaching the bar to the frame, wherein the at least one attachment structure of the frame is configured to limit movement of the removable bar generally to that of the frame, the attachment structure configured to allow release of the removable bar from the frame when a force that overcomes an attachment force provided by the attachment structure is applied to the removable bar, wherein the at least one attachment structure is configured to cooperate with at least one of an inner dimension or an outer dimension defined by an elongate bar for removably attaching the bar to the frame.

DESCRIPTION OF THE DRAWINGS

Drawings of some embodiments of the system are included to assist in explaining the basic inventive ideas. These drawings are intended as illustrations and are not meant to limit the inventive aspects described herein.

DETAILED DESCRIPTION

The subject matter described herein may take form in a variety of embodiments, including but not limited to, the embodiments, components, arrangements of components, assembly methods and arrangements of methods, and apparatus usage procedures and arrangements of procedures as described below. The embodiments described, while possibly being preferred embodiments, are illustrative examples and are not meant to limit the inventive aspects described herein.

Figure 1:
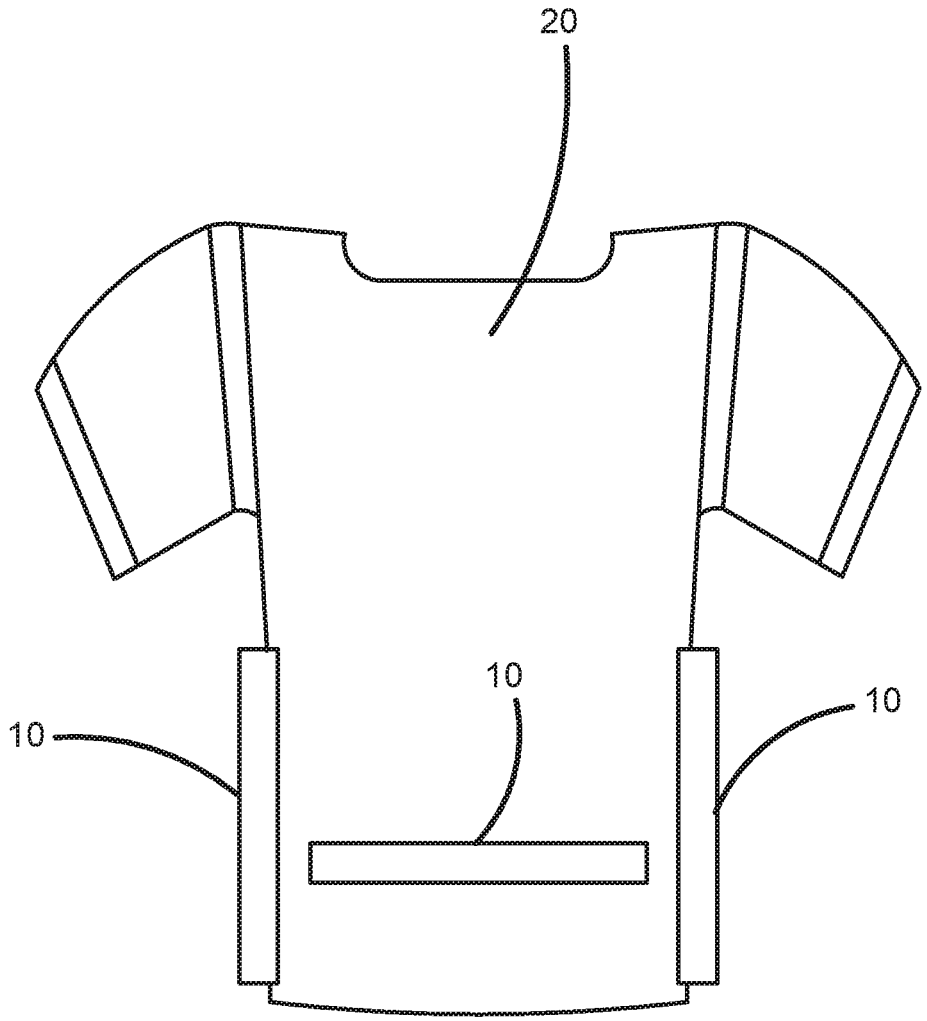
FIG. 1: A football uniform/jersey outfitted with tackling bars having inventive aspects in accordance with the present disclosure.

FIG. 1 illustrates a football jersey 20 including three elongated structures, referred to as tackling bars 10, releasably attached to the jersey 20. A defensive player must grab and remove one of the tackling bars 10 from the jersey to down the ball carrier and end the play. In FIG. 1, one of the tackling bars 10 is shown as attached laterally across the lower back area of a ball carrier. The other tackling bars 10 are located on each side of the jersey 20, extending vertically upward from the hip region toward the arm pits of the ball carrier. The tackling bars 10 may be attached in various positions and quantities on a player's body, preferably on a player's torso between the waist and shoulders. This upper body positioning encourages heads-up play, such that defensive players are not lowering their heads into dangerous positions while attempting to remove a tackling bar 10. In the embodiment of FIG. 1, a defensive player would have to target the side or back of the ball carrier to remove a tackling bar 10, thereby reducing incidents of direct collisions.

According to one embodiment, the tackling bar may be an elongated structure that is made from a soft material, such as foam, rubber, silicone, or the like. A soft, compliable material ensures that the tackling bar will not cause pain or injury if a player falls or lands on the tackling bar.

Figure 2A:
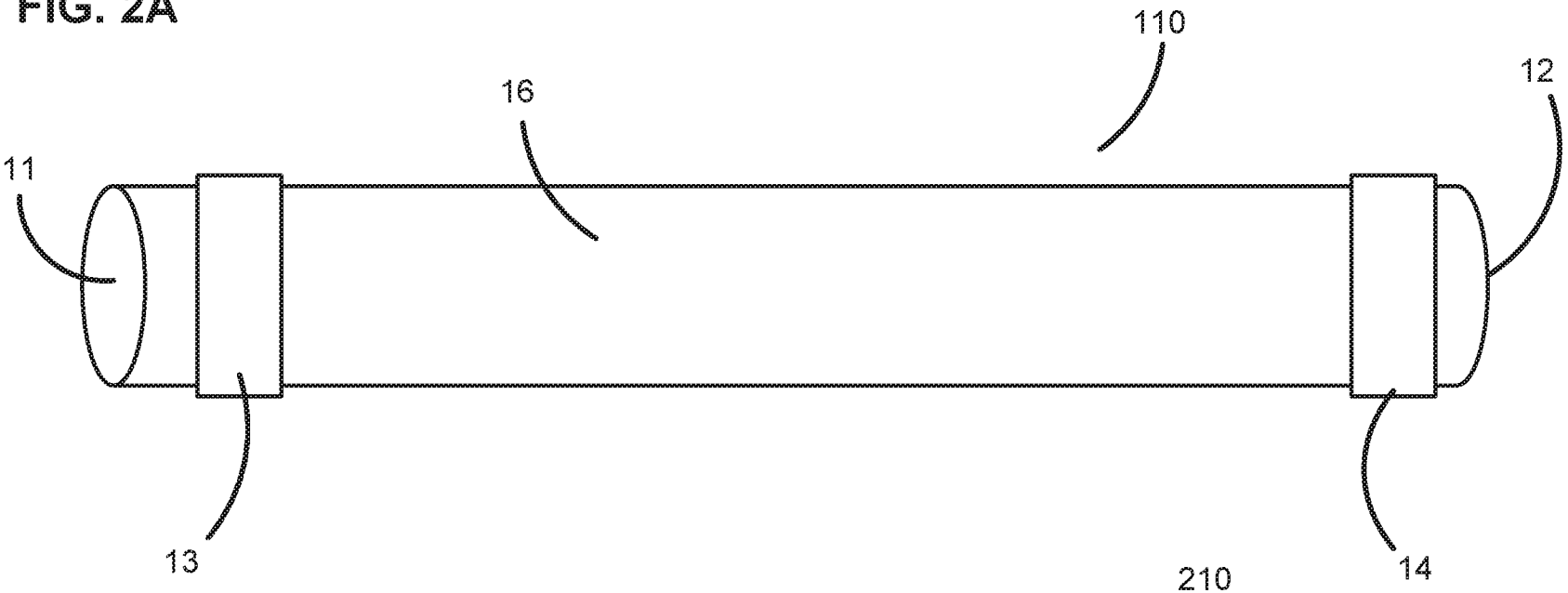
FIG. 2A: A perspective view of a cylindrical tackling bar with two attachment features in accordance with the present disclosure.

FIG. 2A illustrates a cylindrical shaped tackling bar 110 defined by an elongated cylindrical body 16 with opposing ends 11 and 12. The length of the tackling bar can vary, but generally the distance between opposing ends 11, 12 of the elongated structure should be at least great enough to accommodate a single hand grab during removal. In the embodiment of FIG. 2A, the cylindrical body 16 of the elongated structure may function as a handgrip. The body 16 provides appropriate form, size, and shape to be easily and intuitively grasped by a single hand during removal. In other embodiments, the shape of the tackling bar can take on a variety of other forms, such as the rectangular version of a tackling bar 210 illustrated in FIG. 2B. Regardless of the configuration, the various forms, sizes, and shapes of the tackling bar elongated structure should preferably always include a handgrip region appropriately constructed for a single-handed grasp. Furthermore, the tackling bar design should position the handgrip region such that it protrudes from the player so it can be easily distinguished during removal. Thin cross sections or fabric like shapes would not be desirable for a tackling bar, as they lack a handgrip region, making them hard to grasp and distinguish. Furthermore, thin cross sections or fabric like shapes would tend to blend in with a player's body and uniform, rather than protruding therefrom, making removal difficult and unpractical at game speeds. For these reasons, it is fundamental that the tackling bar design and construction presents an easily graspable region that protrudes or extends from the player's body.

Figure 2B:
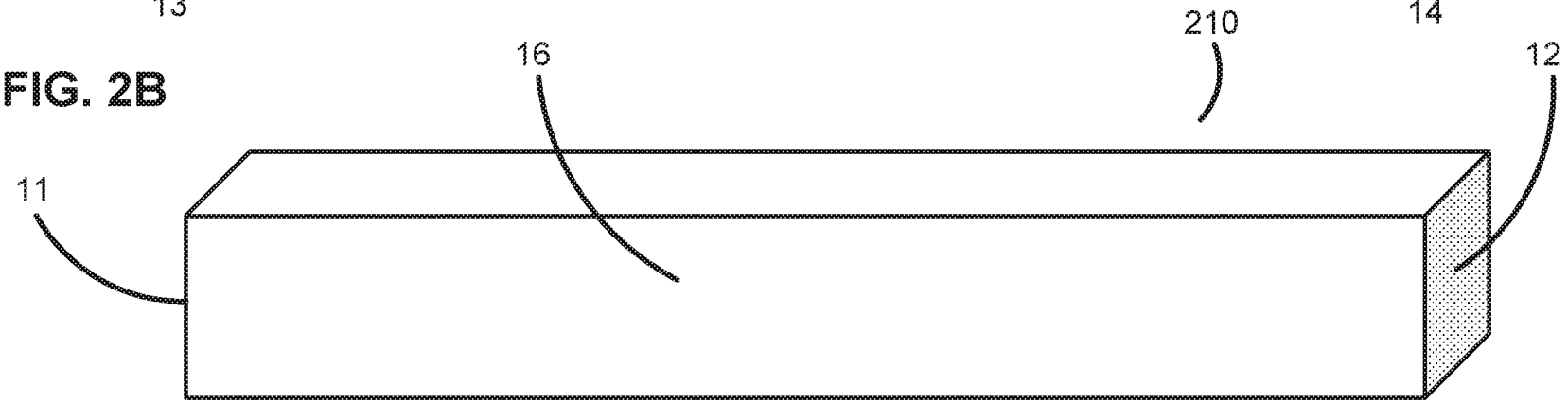
FIG. 2B: A perspective view of a rectangular tackling bar in accordance with the present disclosure.
Figure 2C:
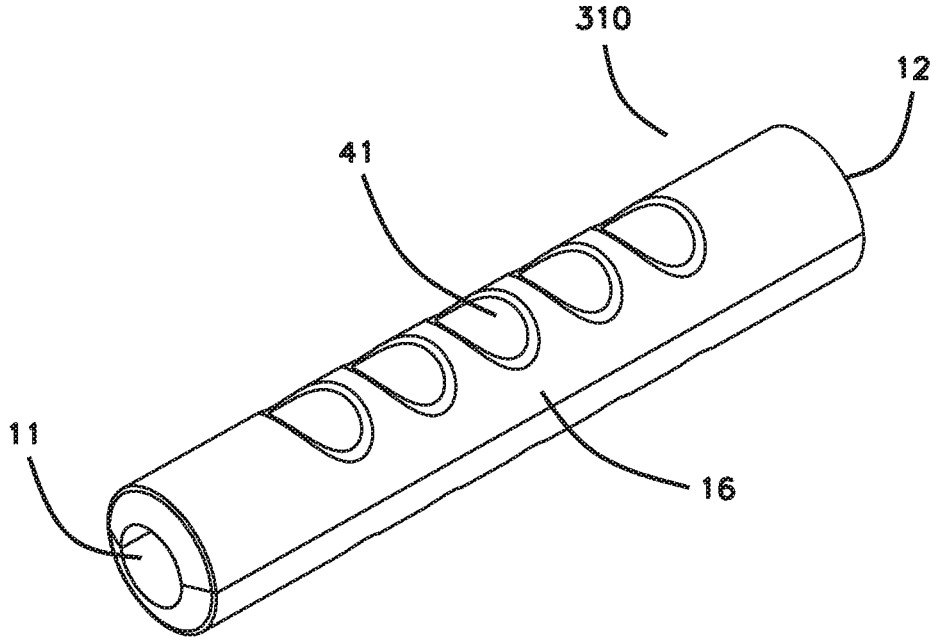
FIG. 2C: A perspective view of another embodiment of a tackling bar with finger grip features.

In other embodiments, such as shown in FIG. 2C, the hand grip region 16 of a tackling bar 310 may even include various features, like finger grips 41 that further provide distinction and tactile feedback in grabbing the bar during removal.

There may be various methods and structures for providing releasable attachment of the tackling bar(s) to a player. The releasable connection must be robust enough to maintain tackling bar attachment to the body while a player runs, jumps, and engages in the various physical motions associated with the game. Conversely, the attachment mechanism must allow release of the tackling bar from the player when the tackling bar is grabbed by a defensive player. Furthermore, re-attachment of the tackling bar must be easy, efficient, and reliable.

FIG. 2A illustrates the tackling bar 110 with a hook-and-loop type (i.e., VELCRO®) attachment. The tackling bar 110 includes hook-and-loop type fasteners 13 and 14 near each opposing end 11 and 12 of the bar 110.

Figure 2D:
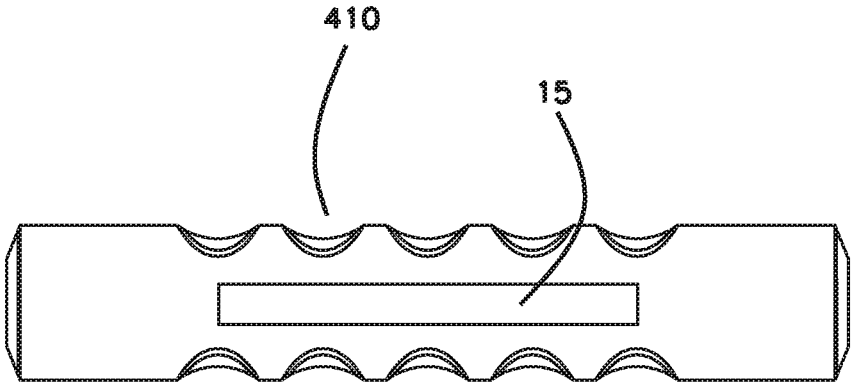
FIG. 2D: A tackling bar similar to that shown in FIG. 2C with a single attachment feature.

FIG. 2D illustrates a tackling bar 410 similar to the tackling bar 310 shown in FIG. 2C with a hook-and-loop type fastener 15 that extends substantially along the length of the bar 410. In both FIGS. 2A and 2D, a mating piece or pieces of hook-and-loop fastener(s) would be incorporated into the player's uniform to releasably attach the tackling bar(s) to the player's body. Hook-and-loop fasteners provide an economical and efficient mechanism for creating the releasable attachment. Many other releasable connection methods will be obvious to those skilled in the art, for example, snaps, clips, buttons, and the like. It is fundamental that the tackling bar construction, along with its attachment provisions, substantially limit motion of the tackling bar independent of the player's motion. For example, the tackling bar 110 in FIG. 2A includes attachment fasteners 13 and 14 strategically placed near each opposing end 11 and 12. In this manner, when attached to a player, the entire elongated structure of the tackling bar is constrained to move in unison with the player. This is an important attribute because defensive fundamentals require reacting to movements of a ball carrier. For example, if the tackling bar 110 in FIG. 2A only included an attachment provision located near one end, the opposing end of the tackling bar 110 would be free to bounce, move, and flutter around as the ball carrier moves, similar to the motion of a conventional flag. Such motion of the tackling bar would be undesirable because it would require a defensive player to react to movements of the accessory rather than movements of the ball carrier, thereby eroding fundamentals of playing defense.

FIG. 2D includes a version of the tackling bar with a single attachment fastener 15 or a single attachment point, but the attachment point extends along a majority of the length of the tackling bar 410 to substantially prevent movement of the tackling bar 410 independent of the movement of the player wearing it. The general combination of provisions that work together to prevent motion of the tackling bar independent of the player include a tackling bar material with adequate stiffness or rigidity to resist independent motion, regardless of where or how many attachment points there are with respect to the player, and/or at least two points of attachment between the tackling bar and player, and/or a single point of attachment that is substantially large/long enough to hold the tackling bar from independent movement. In this manner, tackling bars are significantly integrated with the player's body and the player's movements. This attribute enables a defensive player to focus on and react to the ball carrier's movements, rather than reacting to independent motion of an accessory. This preserves many of the defensive fundamentals of the game, and minimizes the luck factor in removing the tackling bar.

As noted above, FIG. 1 illustrates tackling bars 10 attached to a jersey. There are many other alternative ways to attach the tackling bars to players besides connecting with a jersey. For example, tackling bar(s) could be attached to the waistline of shorts or pants. In another embodiment, suspenders could be fashioned to provide an upper body harness for releasably connecting the tackling bar(s).

Figure 3A:
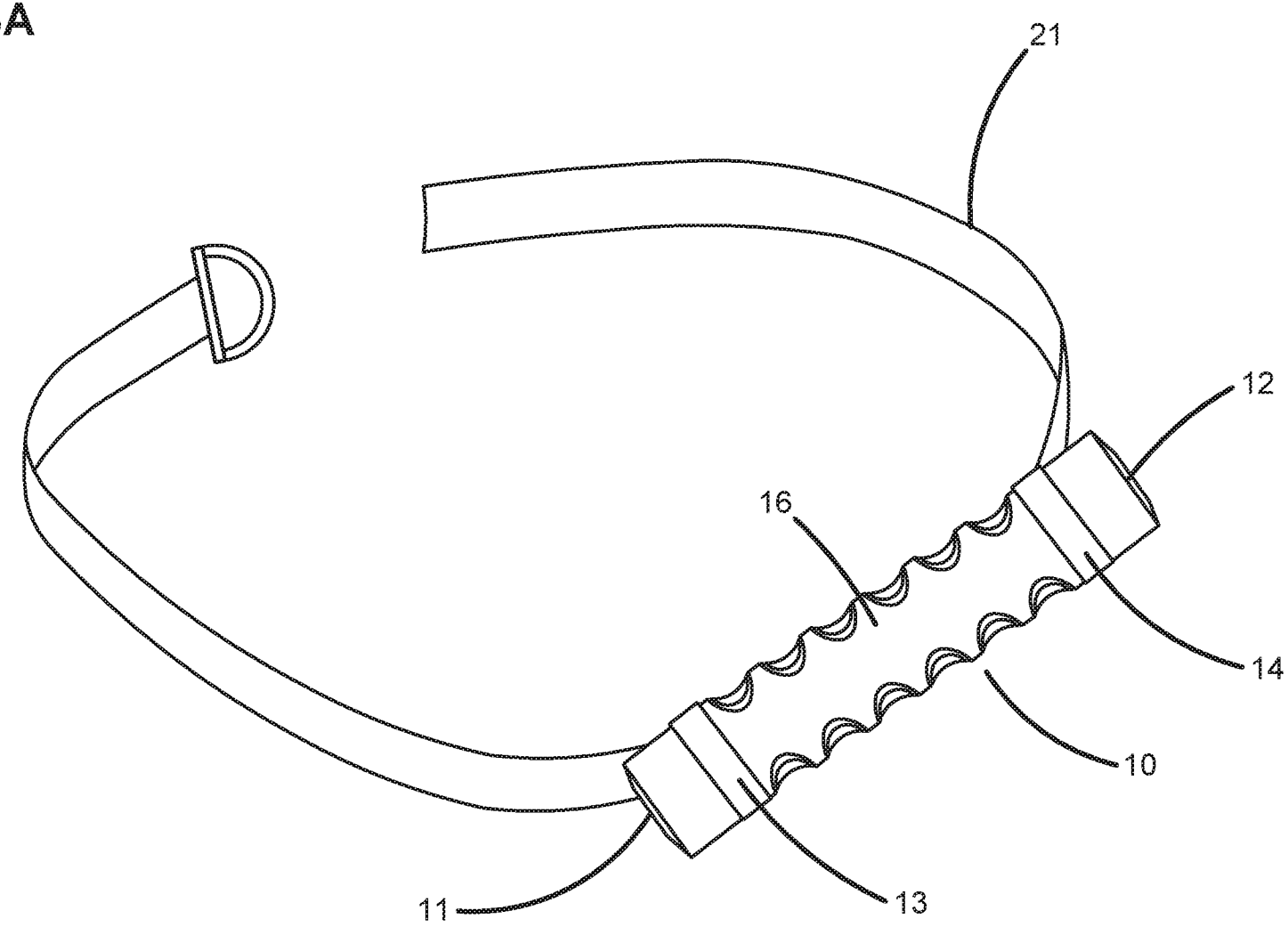
FIG. 3A: A perspective view of a belt that can be worn around a player's torso, the belt including a cylindrical tackling bar similar to those shown in FIGS. 2C and 2D but with two attachment features adjacent the ends of the bar.

FIG. 3A illustrates a tackling bar 10 that is releasably attached to a belt 21 via attachment fasteners 13 and 14. The belt 21 can be worn around the waistline of a player, like a conventional belt, or alternatively could be located around the upper body at various positions between the waist and armpits. The belt 21 can be made of an elastic stretch material to help comfortably secure it around the player's waist or torso.

Figure 3B:
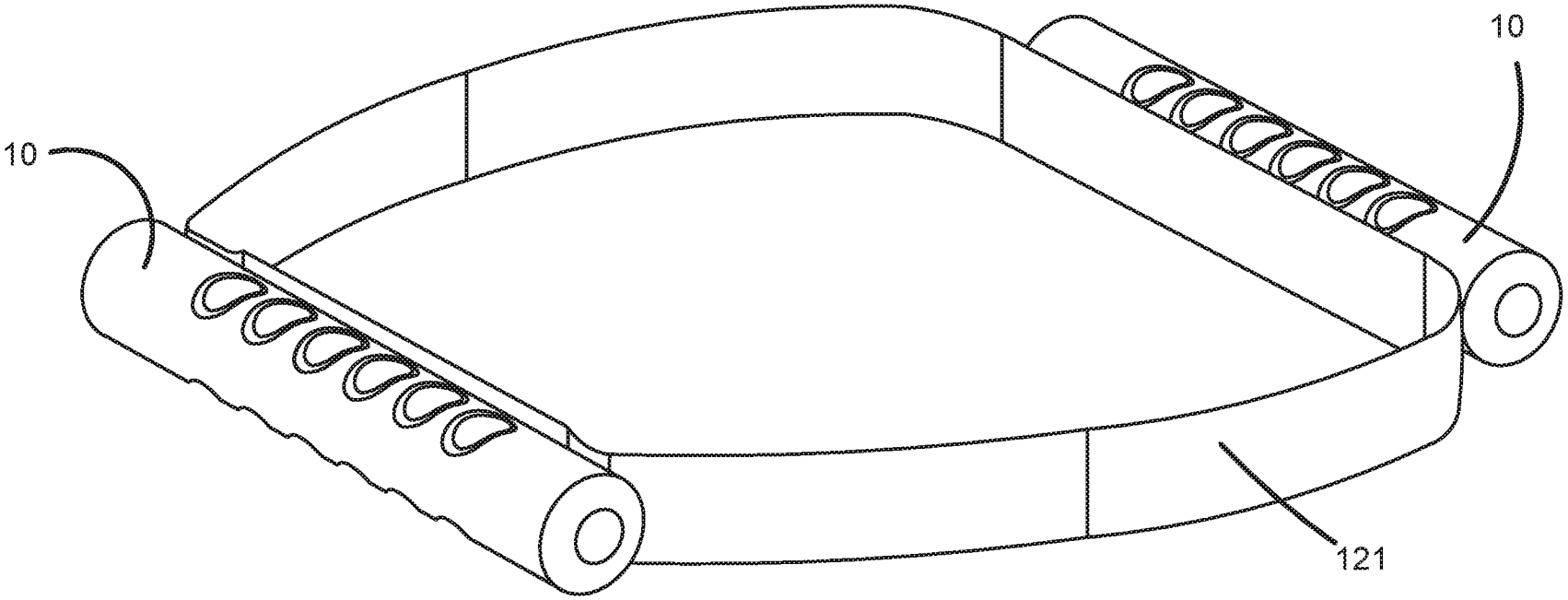
FIG. 3B: A perspective view of a belt similar to that shown in FIG. 3A with two cylindrical tackling bars attached thereto.

FIG. 3B similarly illustrates a belt 121 that is configured to receive two tackling bars. In this embodiment, for example, one bar could be located on the front of the player, while another is located on the back of the player. Alternatively, as another example, the belt 121 in FIG. 3B could be utilized to position a tackling bar on each side of the player, for example in the hip vicinity.

Figure 4A:
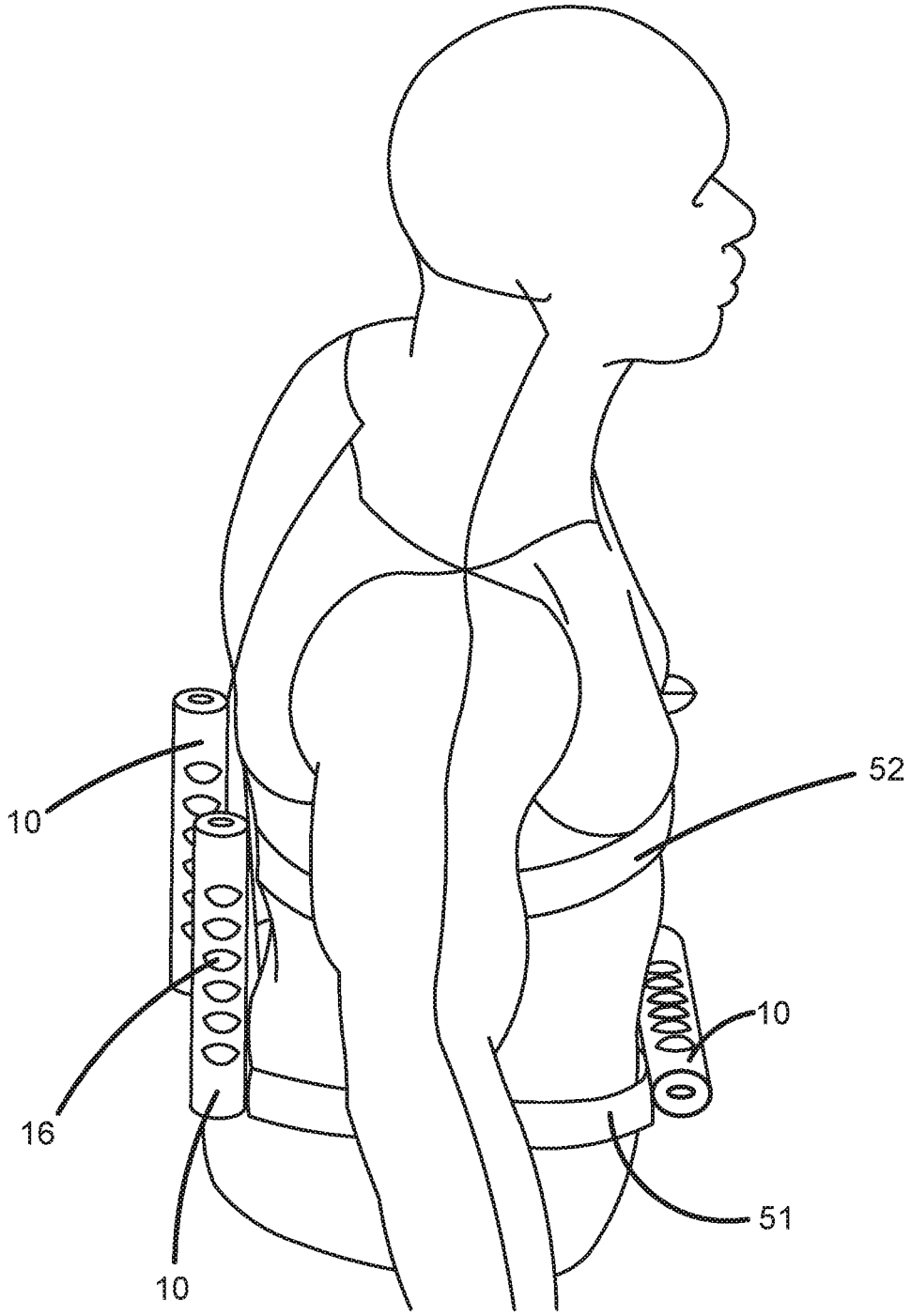
FIG. 4A: A perspective view of a wearable harness configured to receive a plurality of tackling bars.
Figure 4C:
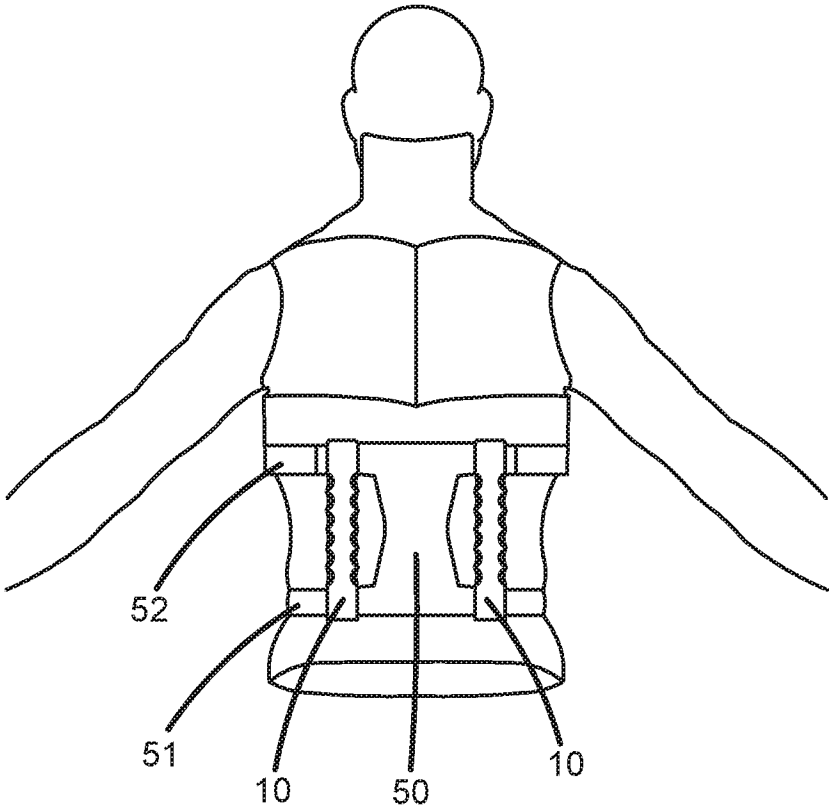
FIG. 4C: A rear view of the wearable harness shown in FIGS. 4A and 4B.
Figure 4B:
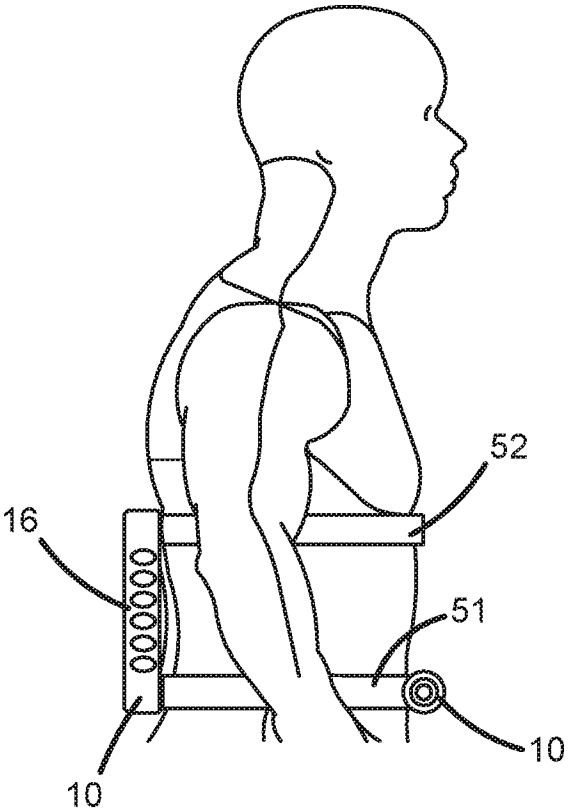
FIG. 4B: A side view of the wearable harness shown in FIG. 4A.

FIGS. 4 and 5 illustrate another embodiment of a provision for releasably attaching tackling bar(s) to a player's body. FIGS. 4A, 4B, and 4C illustrate a harness that includes a frame 50 positioned against a player's lower back region. As noted above, the term harness should not be used in a narrowing manner and may refer to and include structures such as a belt, a jersey, a uniform, or the like that can include attachment provisions for connecting the bar(s) to a player's body.

The harness, as depicted, includes attachment provisions, for example hook-and-loop fasteners, that allow one or more tackling bars 10 to be releasably attached thereto. In the FIG. 4 embodiment, the frame 50 of the harness is attached to the player via means of a waist belt 51 and chest strap 52. FIGS. 4A and 4B illustrate an additional tackling bar 10 releasably attached to the waist belt 51 on the front side of the player. This arrangement places tackling bars 10 on both the front and back sides of the player, thereby providing more options for a defensive player to down the ball carrier.

Figure 5A:
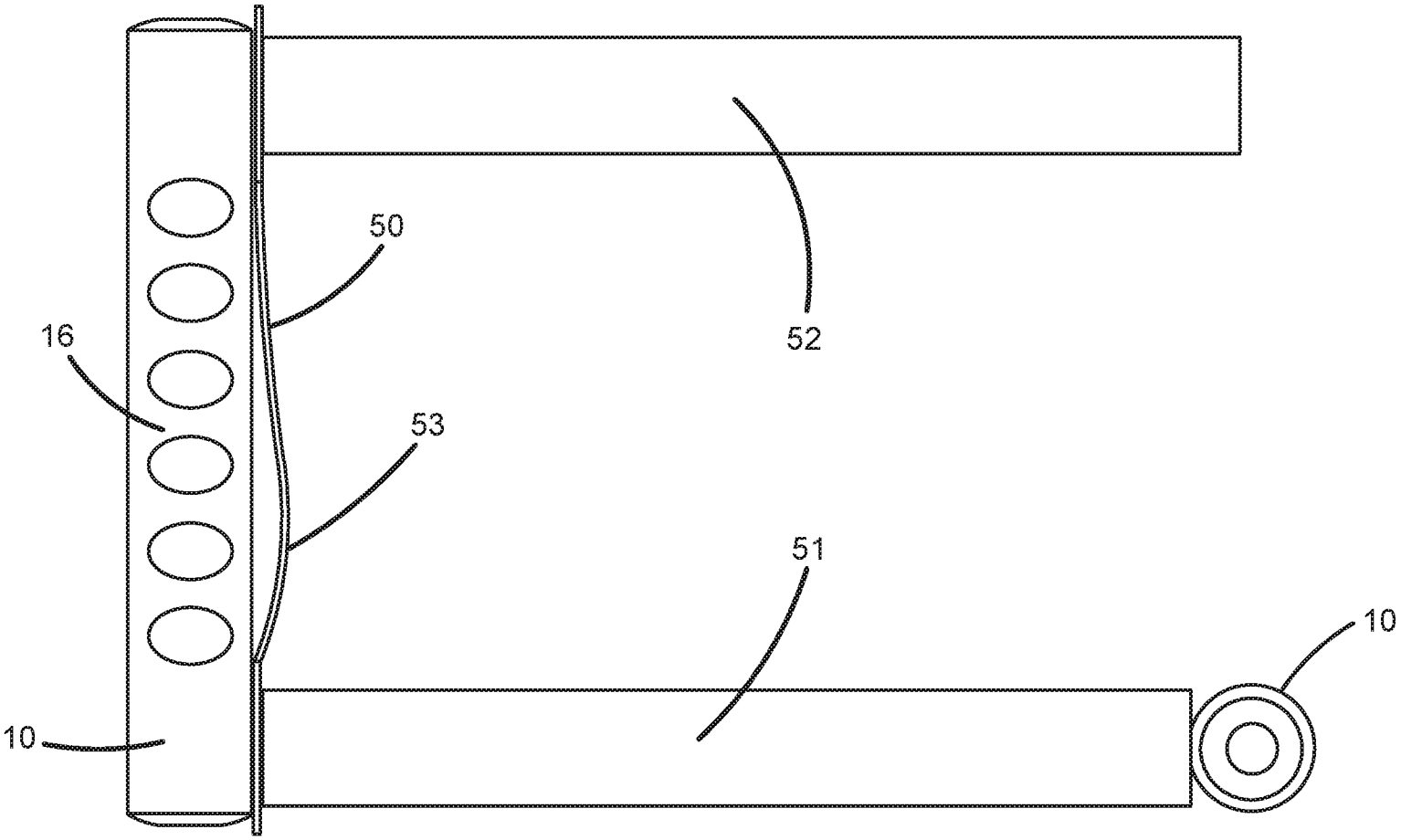
FIG. 5A: A close up side view of the wearable harness of FIG. 4B shown in isolation removed from a ball carrier's torso.
Figure 5B:
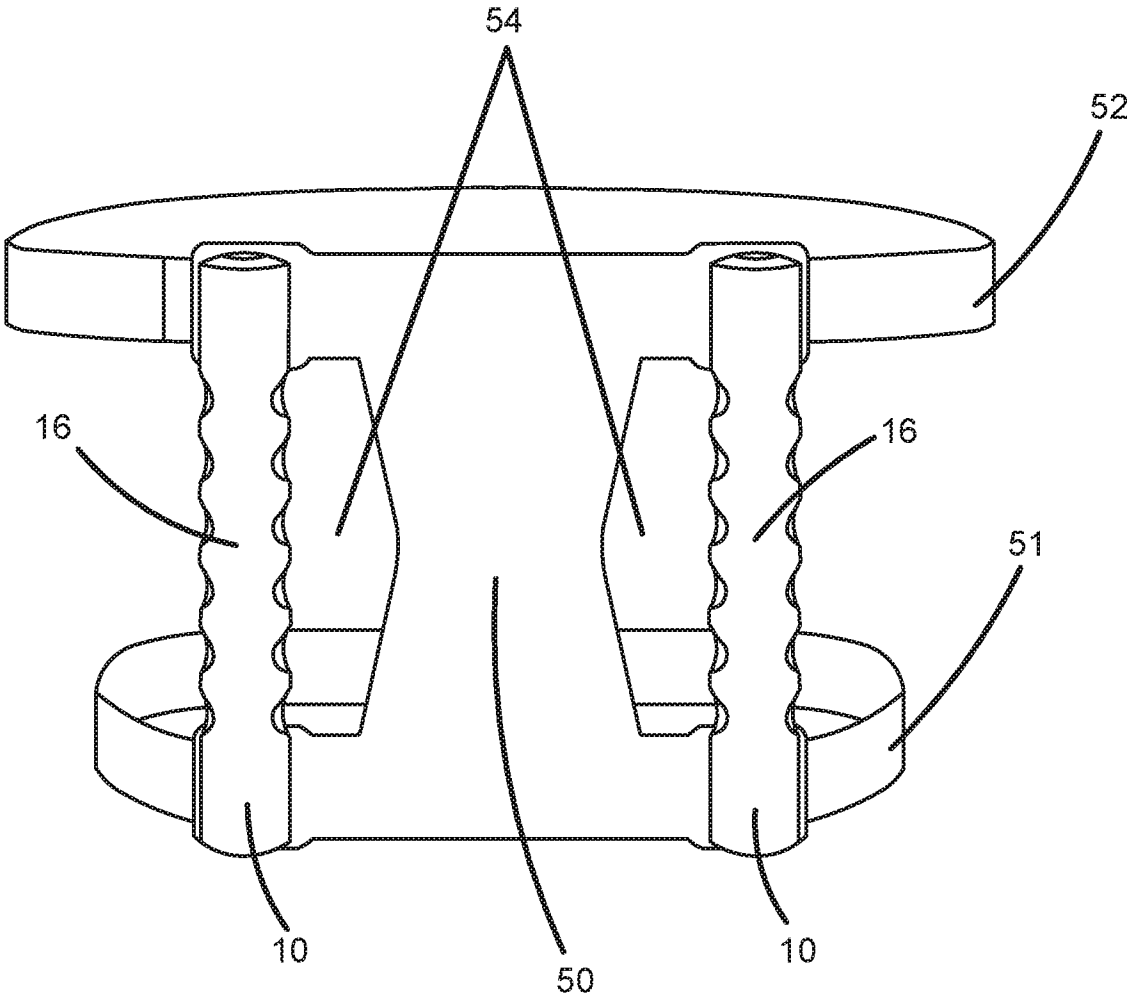
FIG. 5B: A close up rear view of the wearable harness of FIG. 4C shown in isolation removed from a ball carrier's torso.
Figure 5C:
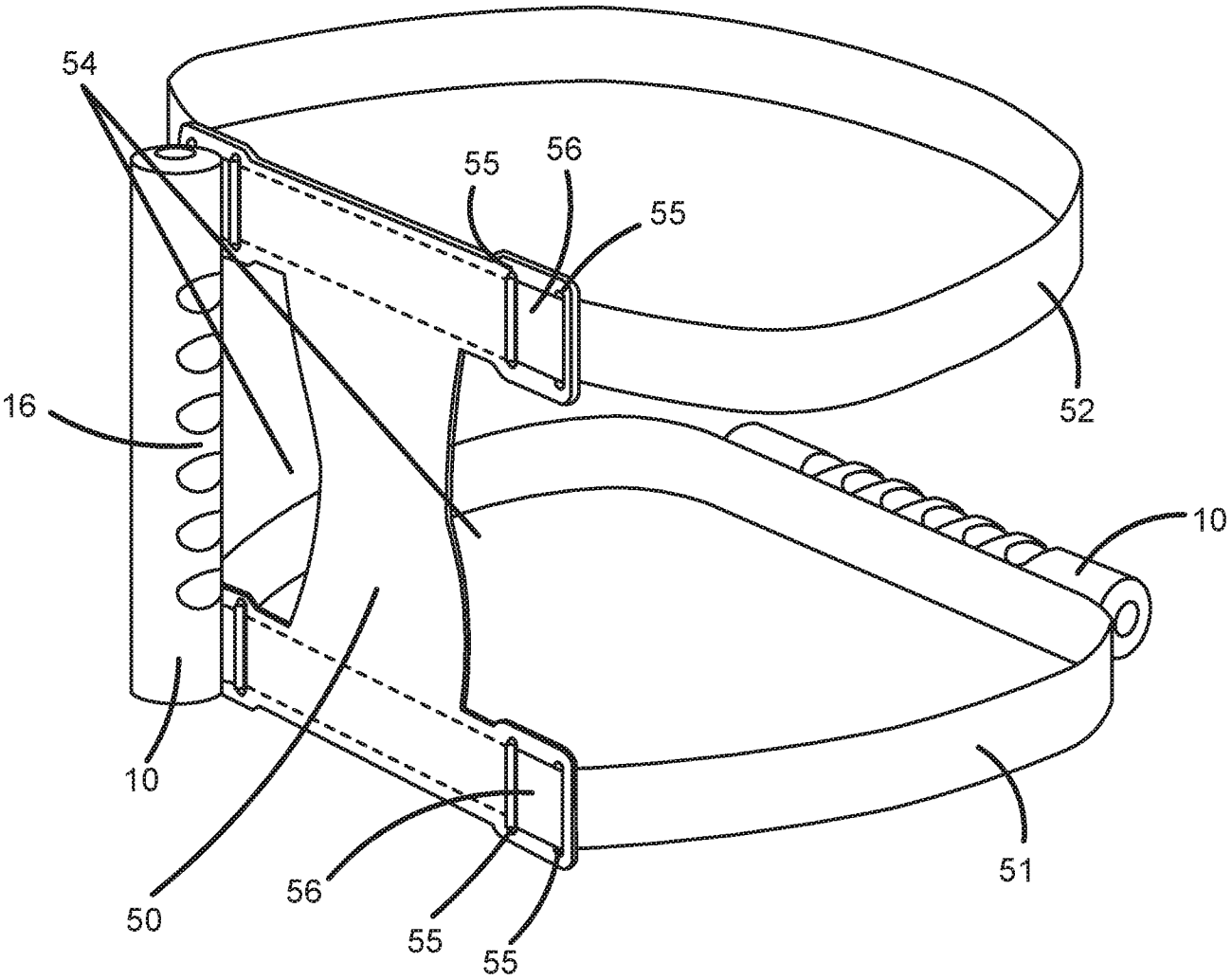
FIG. 5C: A rear perspective view of the wearable harness of FIGS. 5A and 5B shown in isolation removed from a ball carrier's torso.
Figure 6:
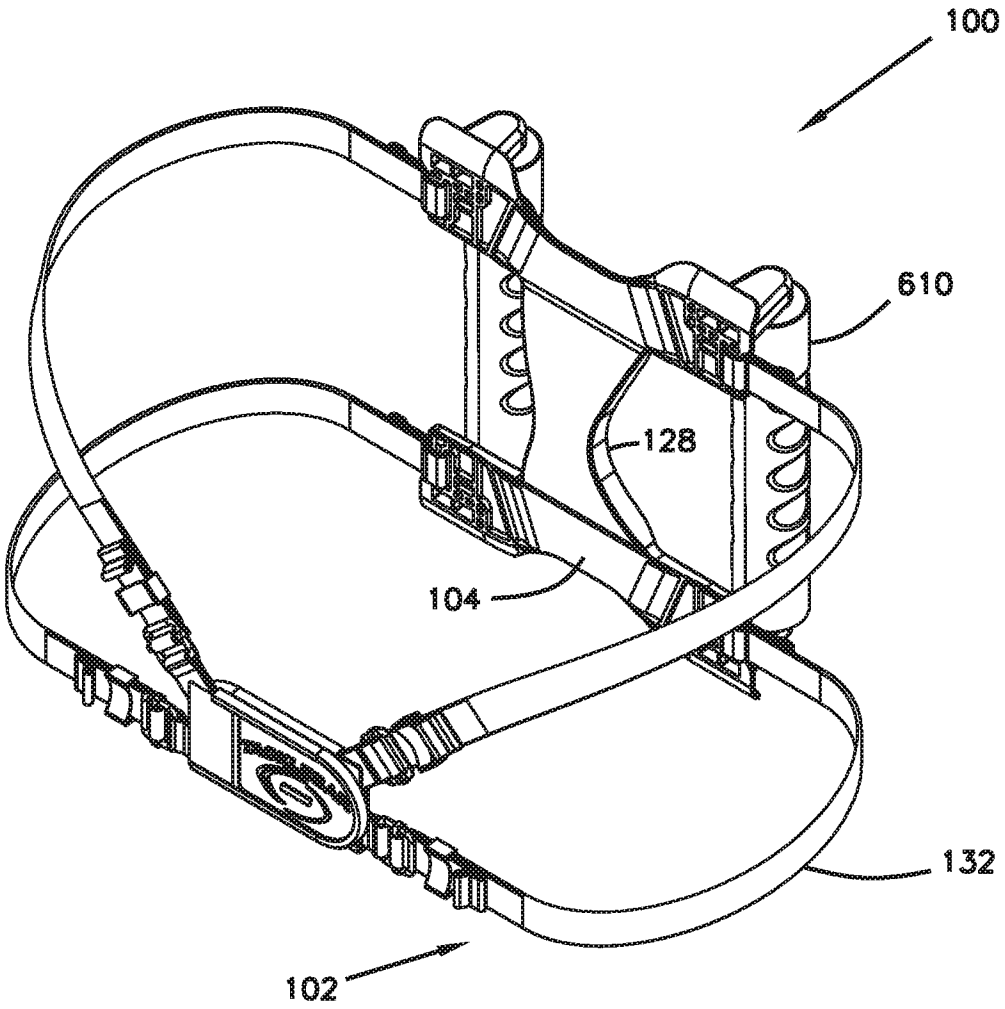
FIG. 6: A front perspective view of an alternative tackle training system having features that are examples of inventive aspects in accordance with the present disclosure, the tackle training system including a wearable harness defining a frame and a plurality of tackling bars attached thereto.
Figure 7:
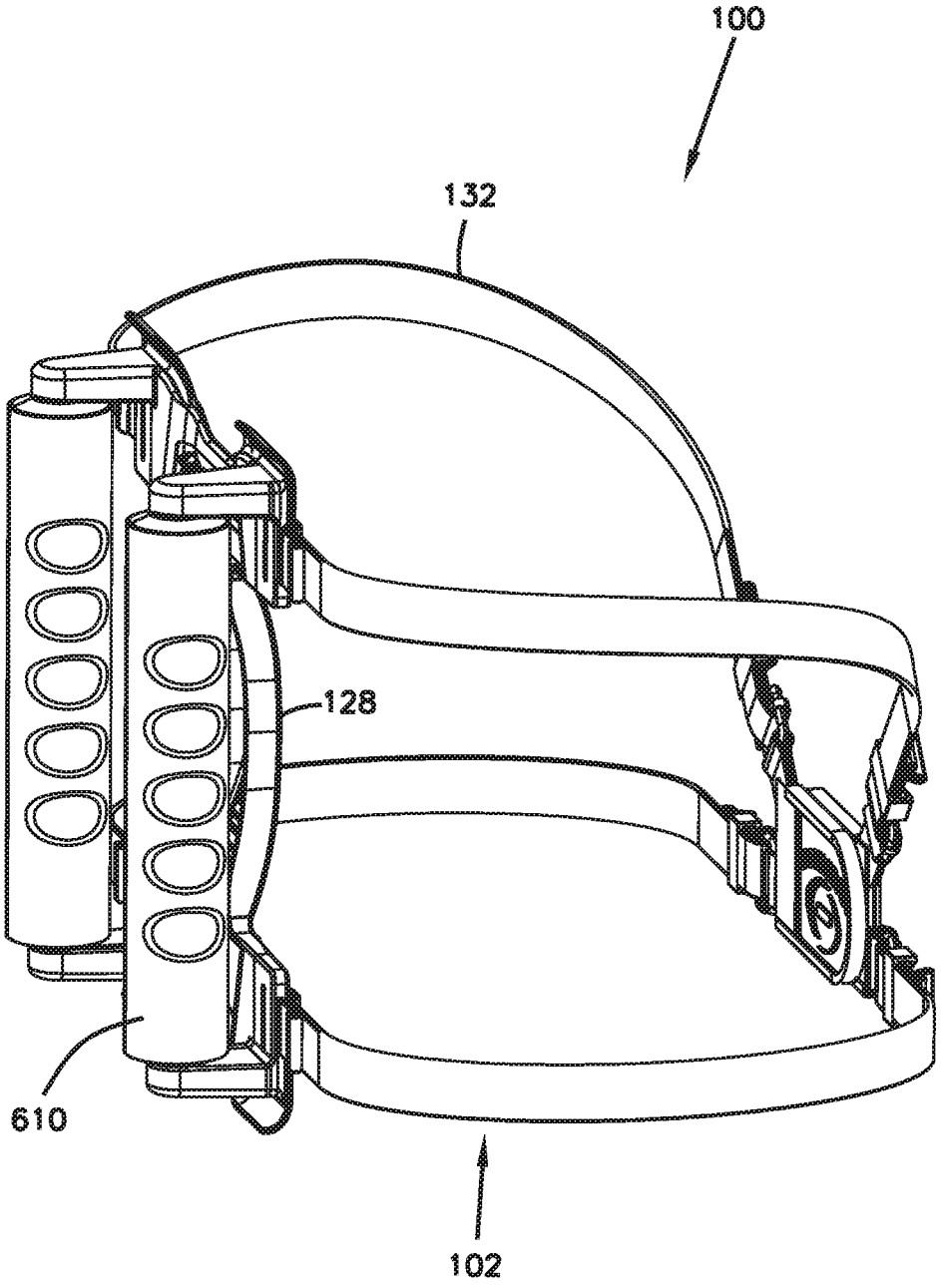
FIG. 7: A rear perspective view of the tackle training system of FIG. 6.
Figure 8:
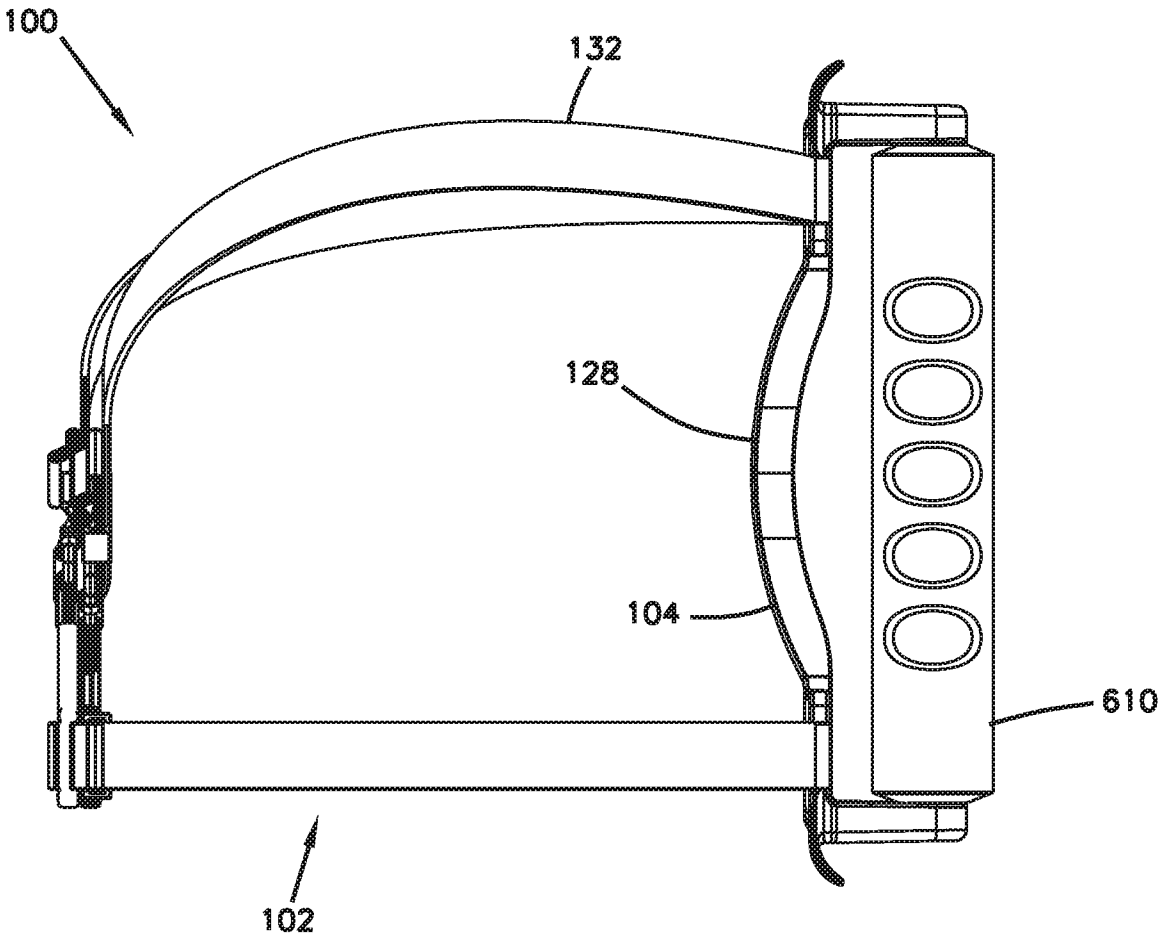
FIG. 8: A side view of the tackle training system of FIG. 6.

FIGS. 5A, 5B, and 5C further illustrate details of the embodiment of FIGS. 4A, 4B, and 4C. The frame 50 of the harness, for example, may be made of conformable foam or polymer type materials for fit, comfort, and safety. FIG. 5A further illustrates a lumbar curve feature 53 that helps position and fit the frame 50 against the lower back region of a player. The frame 50 along with the waist belt 51 provides reliable and convenient means for controlling placement and location of tackling bar(s) 10, ensuring that players are consistently wearing the tackling bar(s) 10 in the correct location.

Furthermore, the frame 50 of the harness can position the tackling bar(s) 10 such that they can be easily distinguished while attempting to down the ball carrier. For example, loose fitting shirts or jerseys could conceal or increase the difficulty in distinguishing, grabbing, and removing a tackling bar 10. It could be common, for example, to inadvertently grab a player's jersey rather than a tackling bar in attempting to down the ball carrier. The frame 50 can overcome these difficulties by positioning the tackling bar(s) in a stable, clear, and un-obstructed position. FIGS. 4A and 4B clearly show the tackling bars 10, and in particular the handgrip defined by the body 16, protruding from the player's torso such that they can be easily identified and grasped by the defense during removal. This arrangement is important for minimizing the luck factor in downing the ball carrier. For example, if the tackling bar(s) are difficult to access or grab, the ball carrier could escape despite the defensive player being in a good position to make a play.

FIGS. 5B and 5C further illustrate details of a system that positions the tackling bar(s) for clear, un-obstructed removal. For example, the frame 50 of the harness includes a cutout area 54 in the vicinity of each tackling bar 10. The cutout areas 54 of the frame 50 provide further open and clear access for a defensive player to reach in and grab a tackling bar 10.

FIG. 5C illustrates the system with one of the tackling bars removed from the harness. As shown, in an embodiment such as the one illustrated, the waist belt 51 and chest strap 52 may not form a permanent or integral part of the harness. The waist belt 51 and the chest strap 52 may be removably attached to the frame 50 to form the harness. As shown, they are threaded through slots 55 in the frame 50, which enables the waist belt 51 and chest strap 52 to be easily removed and replaced. This arrangement facilitates several benefits. Certainly football players come in various shapes and sizes. This embodiment allows the waist belt 51 and chest strap 52 to be swapped out as necessary to accommodate different sized players. Furthermore, the waist belt 51 and chest strap 52 may be dual purpose in that they are made from, or include, hook-and-loop fastener material. As shown in FIG. 5C, the slots 55 allow the waist belt 51 and chest strap 52 to thread through the frame 50 in such a way as to present a discrete attachment location 56 for attaching a tackling bar 10. This further ensures the tackling bar(s) can only be connected in a single correct location, providing a type of keying for attachment of the tackling bar(s). Furthermore, if the hook-and-loop fasteners become worn with use, the waist belt 51 and chest strap 52 can easily be swapped out to provide a new hook-and-loop attachment surface.

The embodiment illustrated in FIGS. 4 and 5 would enable modular use of the system. For example, the system can be universally applied to various players. By comparison, attaching tackling bar(s) directly to a uniform has inherent challenges. For example, the vast variations in jersey sizing and fit can present challenges in consistently placing and locating tackling bars on a player's body. Furthermore, when non-organized youth football games, for example back yard or pick-up style games, are considered, in these contexts, requiring a special shirt, jersey, or uniform to facilitate tackling bar attachment could be cumbersome compared to utilizing the more universal modular harness accessory for facilitating tackling bar attachment.

As discussed, removal of a tackling bar downs the ball carrier and ends the play. Various technologies could be included in the system to help indicate that a tackling bar has indeed been removed and the play is over. For example, removal of a tackling bar could cause a light to illuminate, thereby providing a visual cue that the play is over. The visual cue may also be provided by the difference in the color of the tackling bar(s) and the harness worn on the player.

Similarly a noise, such as a whistle, siren, or even a voice could be triggered by the removal of a tackling bar, again providing a sensory cue to players, referees, and fans that the ball carrier is down and the play is over. Hook-and-loop fasteners make their own distinct sound during removal, and therefore could be another means of providing audible feedback to the players that a tackling bar has been removed. Many other means and methods to provide feedback that a tackling bar has been removed are contemplated by the inventive aspects of the present disclosure.

The tackling bar system has thus far been discussed mainly in the context of American football and more specifically in the context of downing a ball carrier. The system and the accessories of the system are applicable to all types of American football, including padded, non-padded, youth through adult, organized leagues, or backyard pick-up games. The system is applicable to other types of games such as Rugby and the like. As noted above, the tackling bar harness and the systems of the present disclosure could be used as a practice tool, for example placing the tackling bars in strategic locations to teach form-tackling techniques. Additionally the tackling bar system could similarly be used to facilitate other games. For example, requiring removal of a bar rather than simply just tagging the person could enhance a basic game of tag. Various other games could similarly leverage the system and its accessories.

FIGS. 6-11 illustrate yet another embodiment of a system 100 that includes an alternative provision for releasably attaching tackling bar(s) 610 to a player's body. FIGS. 12-18 illustrate an alternative harness 102 of the system 100 in isolation. As noted above, the term harness should not be read broadly and may refer to and include structures such as a belt, a jersey, a uniform, or the like that can include attachment provisions for connecting the tackling bar(s) to a player's body.

Figure 9:
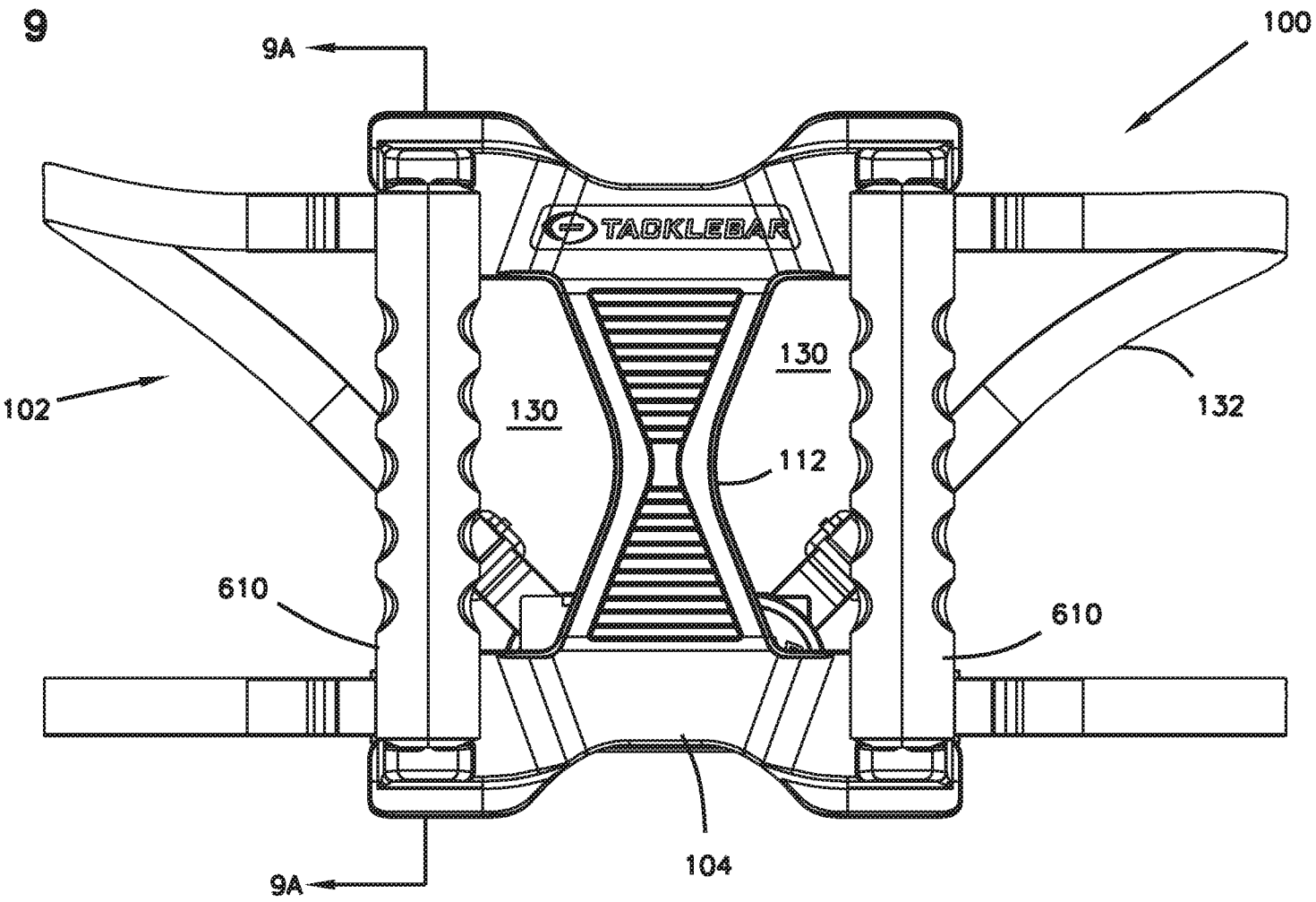
FIG. 9: A rear view of the tackle training system of FIG. 6.
Figure 9A:
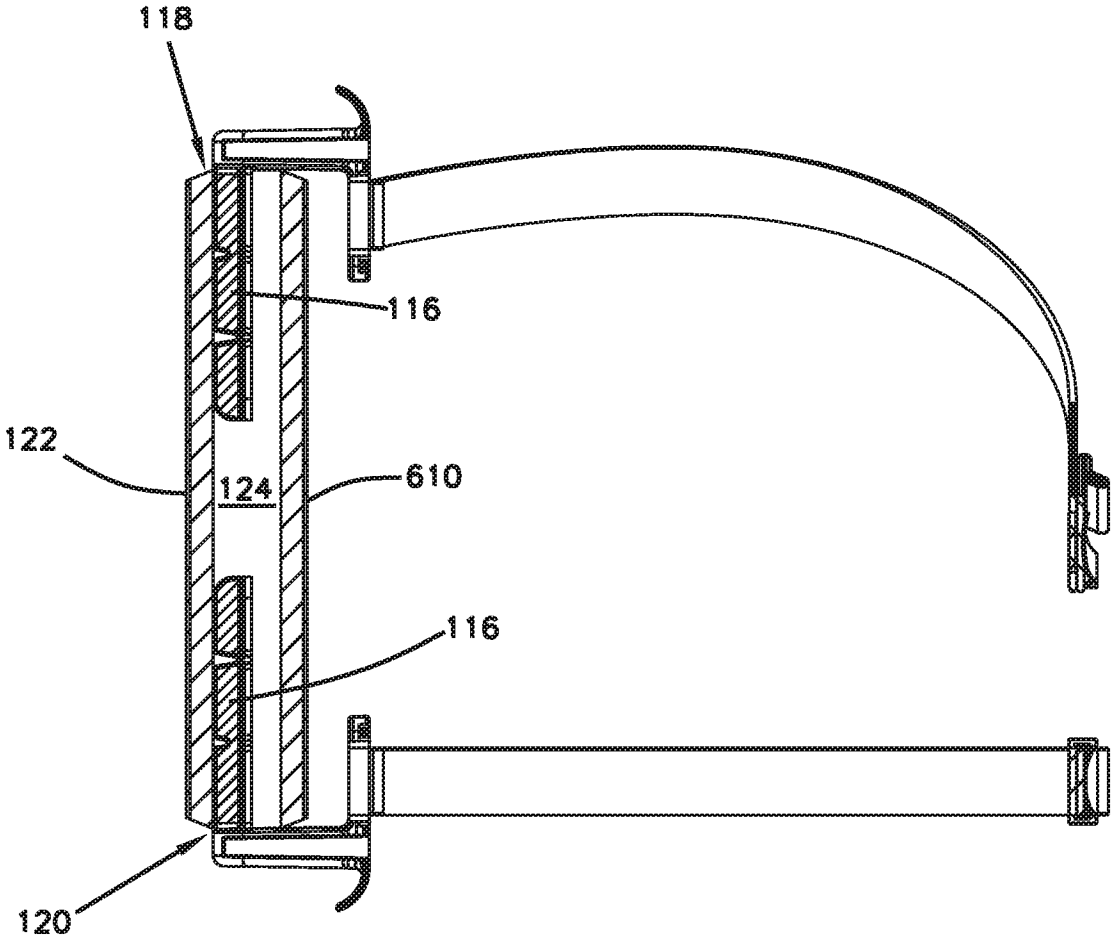
FIG. 9A: A cross-sectional view of the tackle training system of FIG. 6, taken along line 9A-9A of FIG. 9, illustrating the attachment between the frame and one of the bars of the system.
Figure 10:
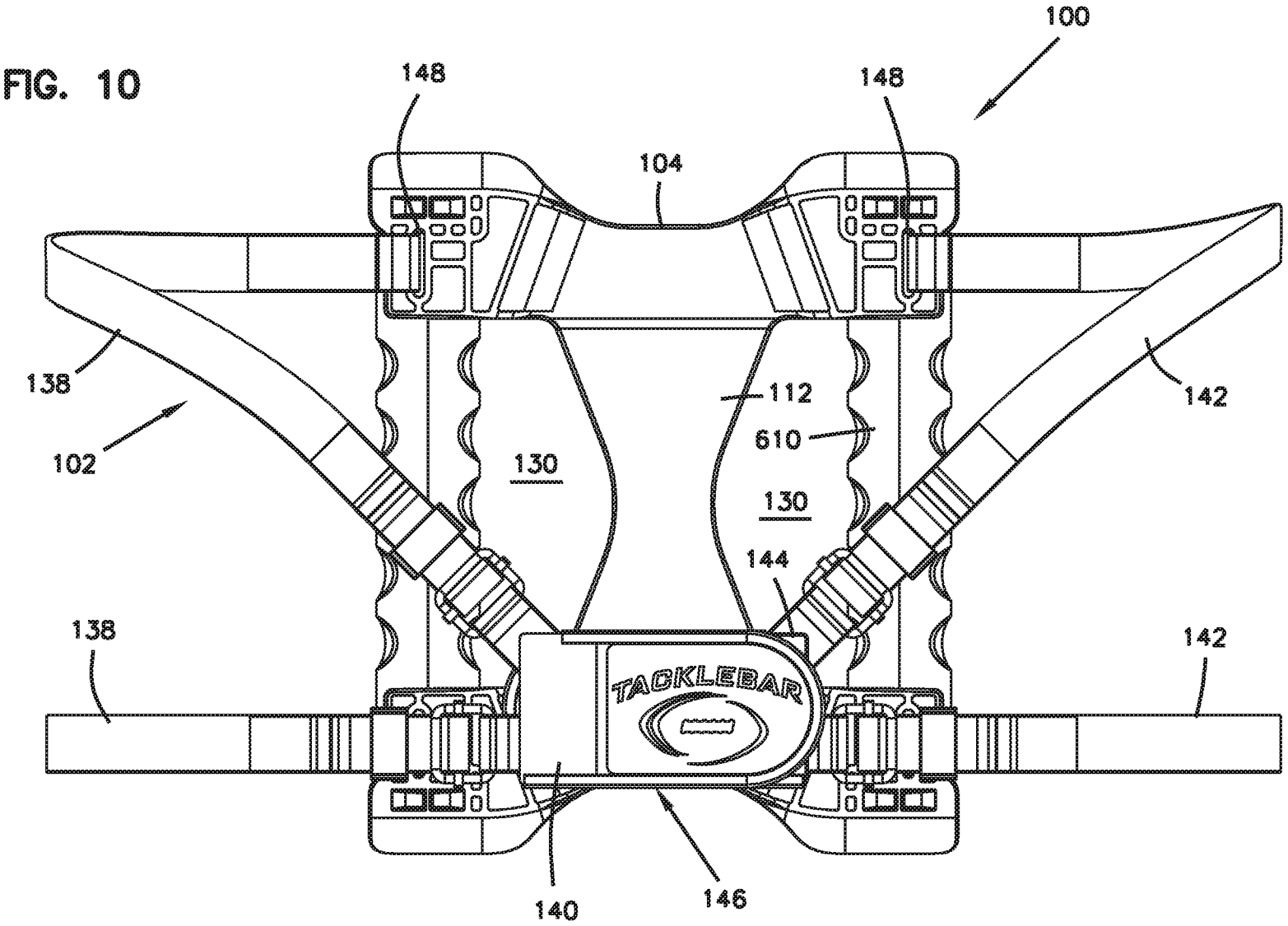
FIG. 10: A front view of the tackle training system of FIG. 6.
Figure 11:
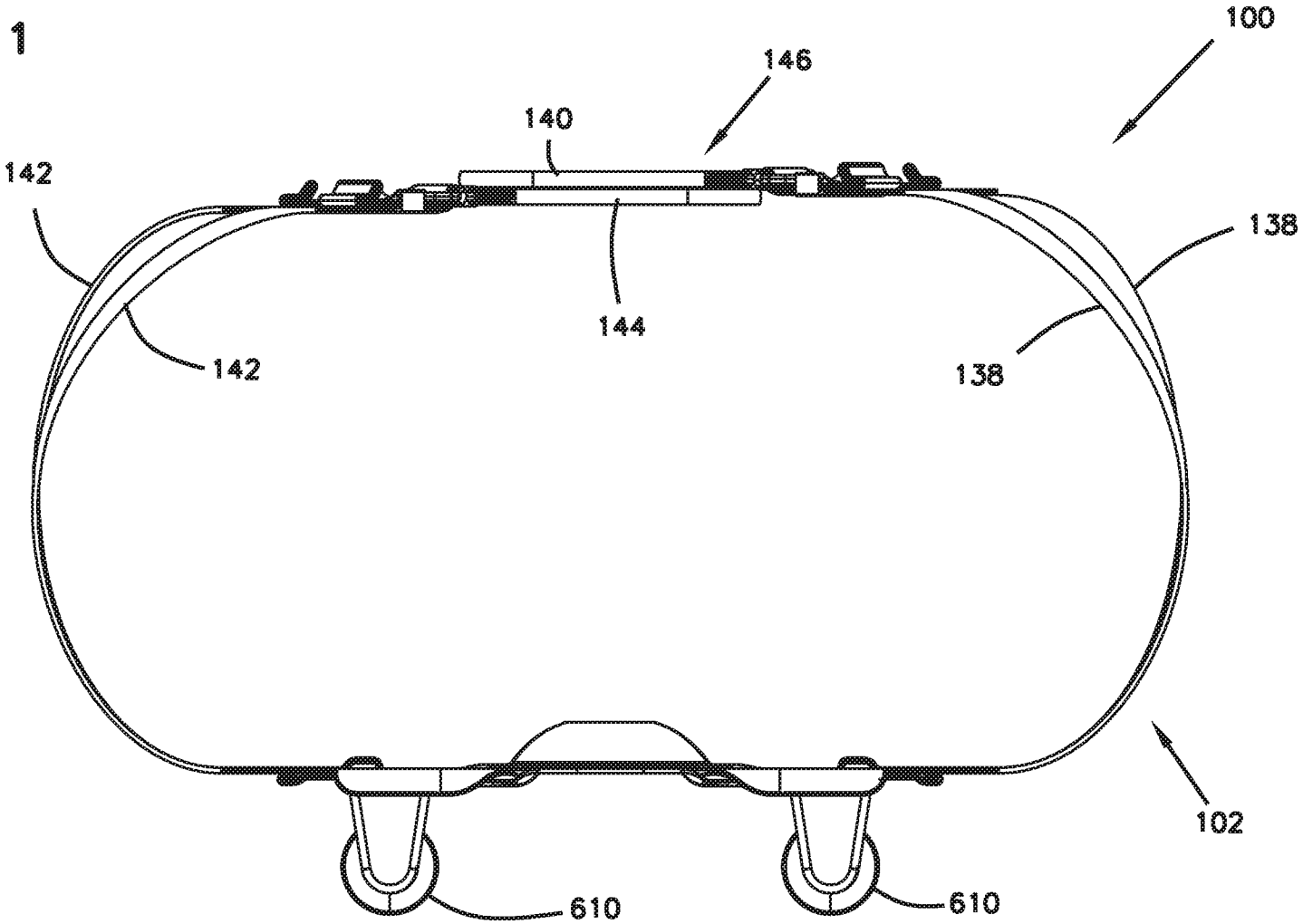
FIG. 11: A top view of the tackle training system of FIG. 6.
Figure 12:
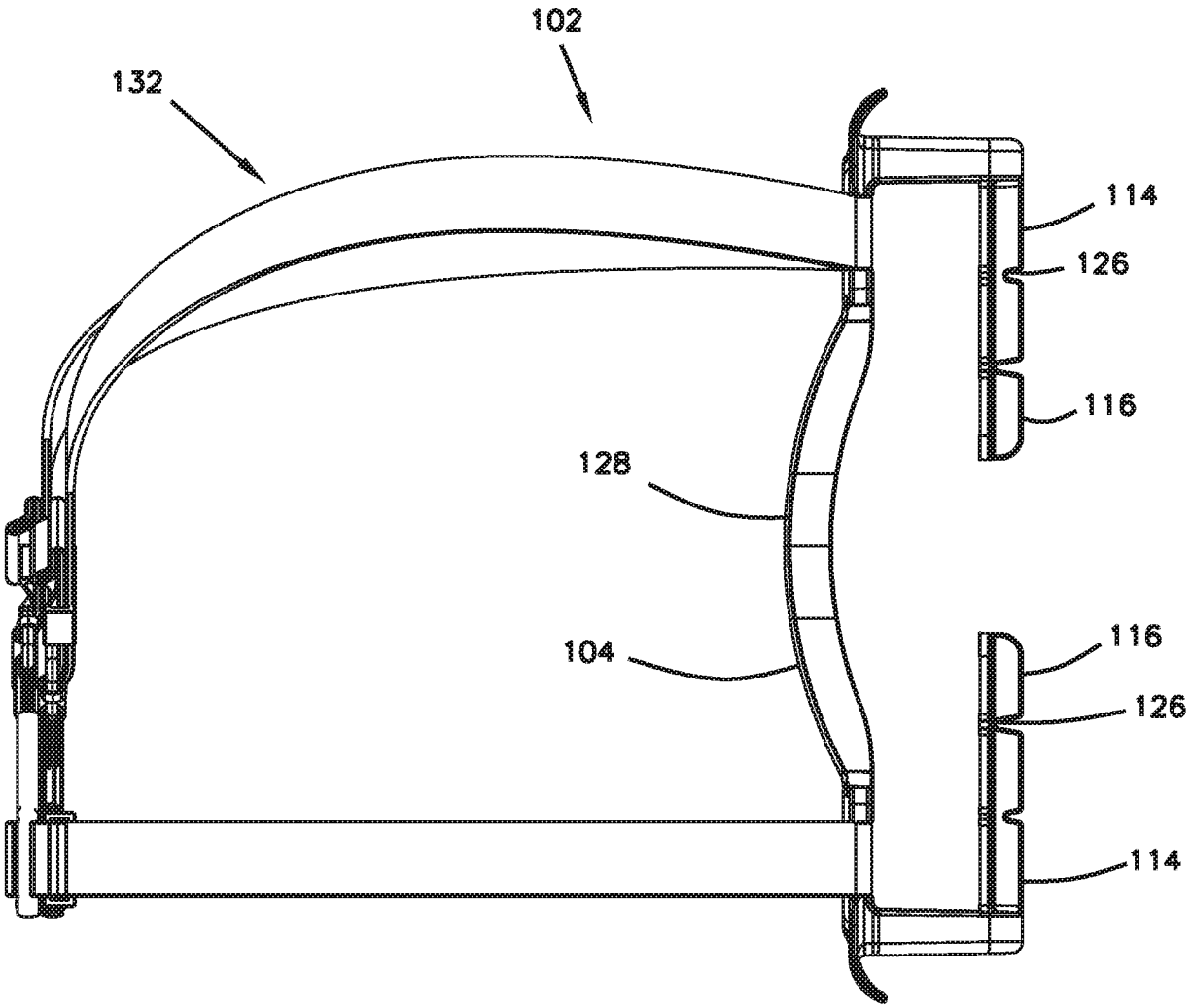
FIG. 12: A side view of the wearable harness of the tackle training system of FIGS. 6-11, the wearable harness defining a frame including features that are examples of inventive aspects in accordance with the present disclosure.
Figure 13:
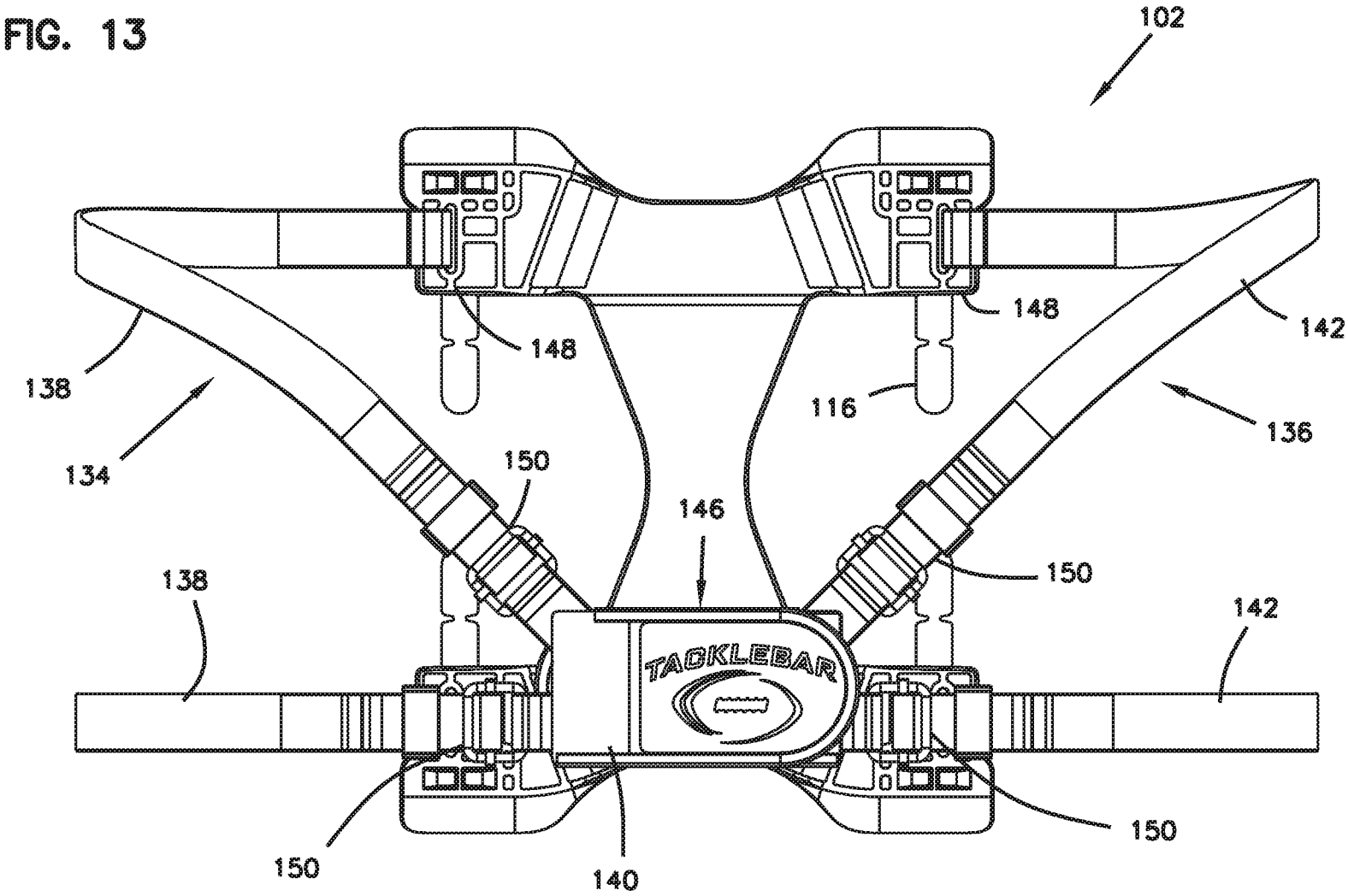
FIG. 13: A front view of the harness of FIG. 12.
Figure 14:
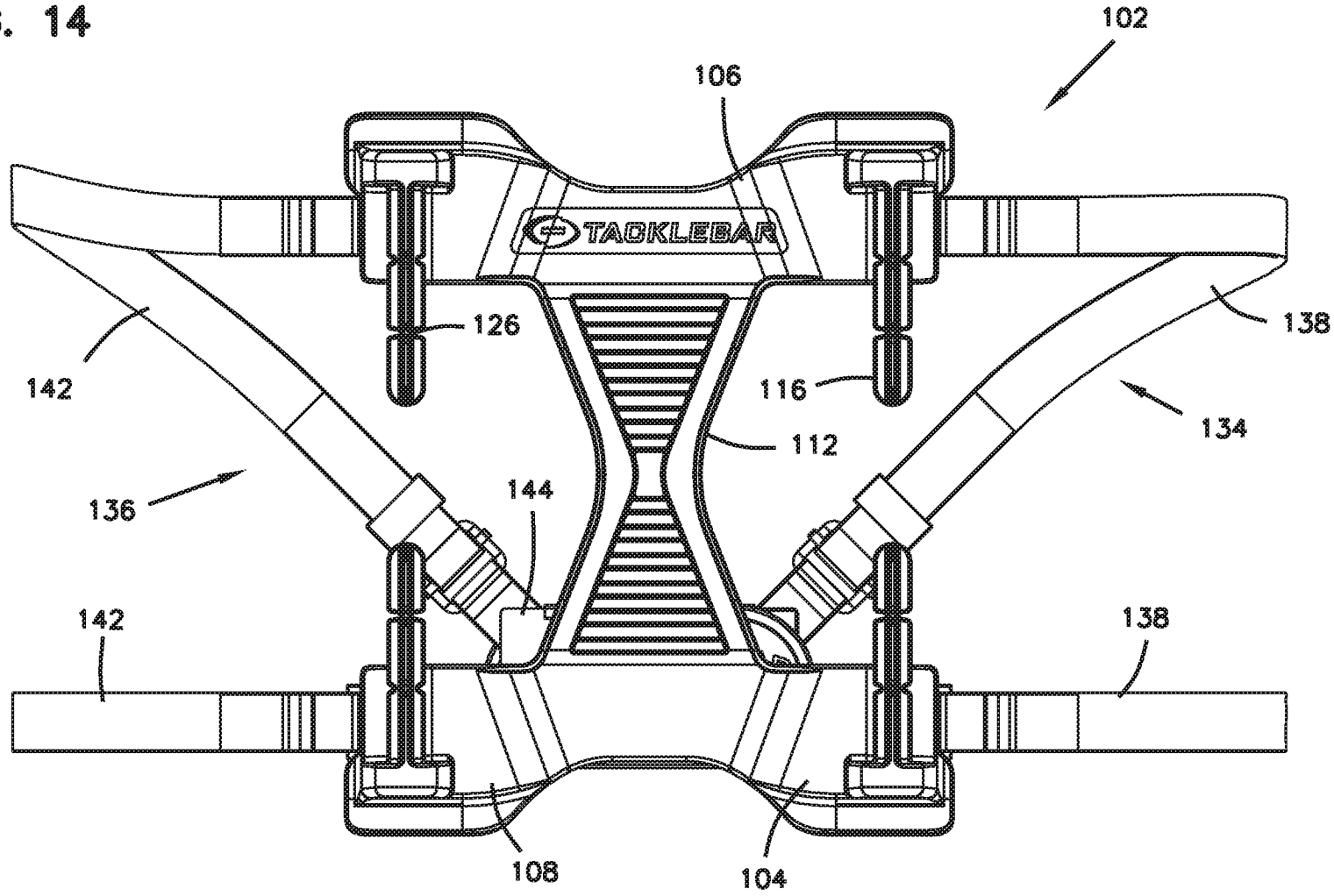
FIG. 14: A rear view of the harness of FIG. 12.
Figure 15:
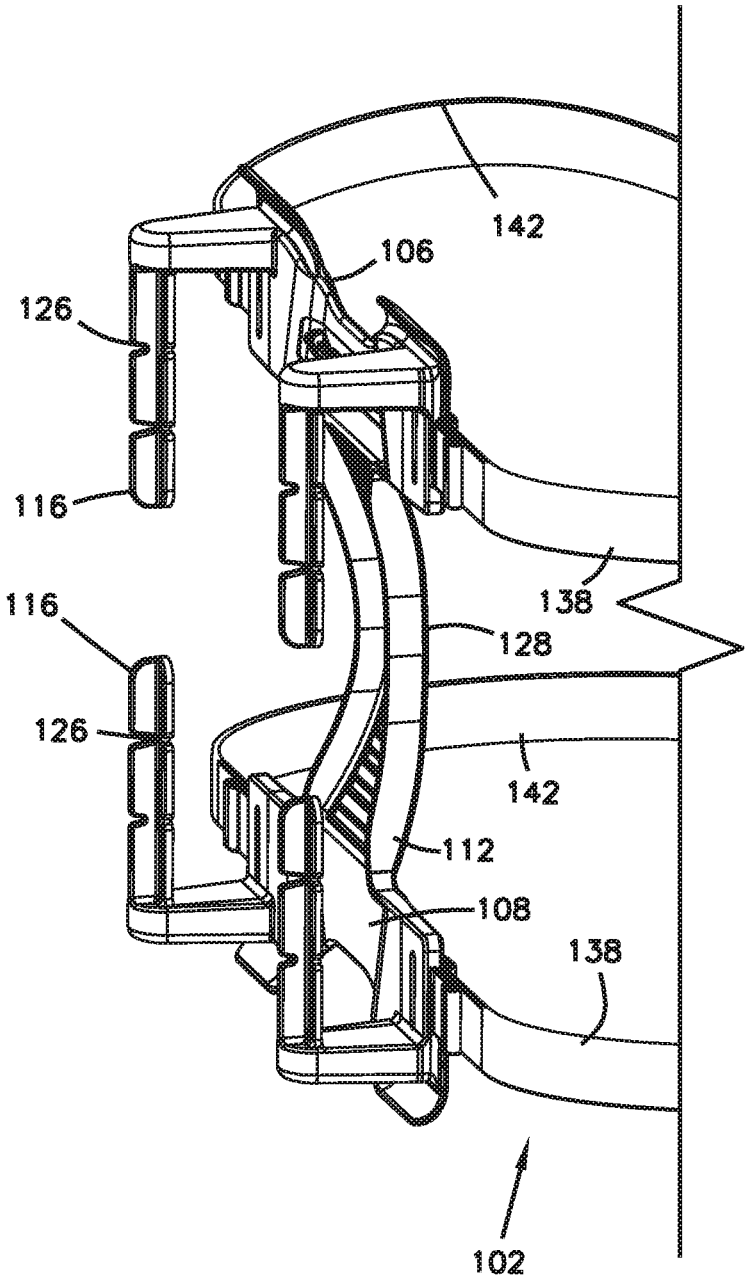
FIG. 15: A rear perspective view of a portion of the harness of FIG. 12.
Figure 16:
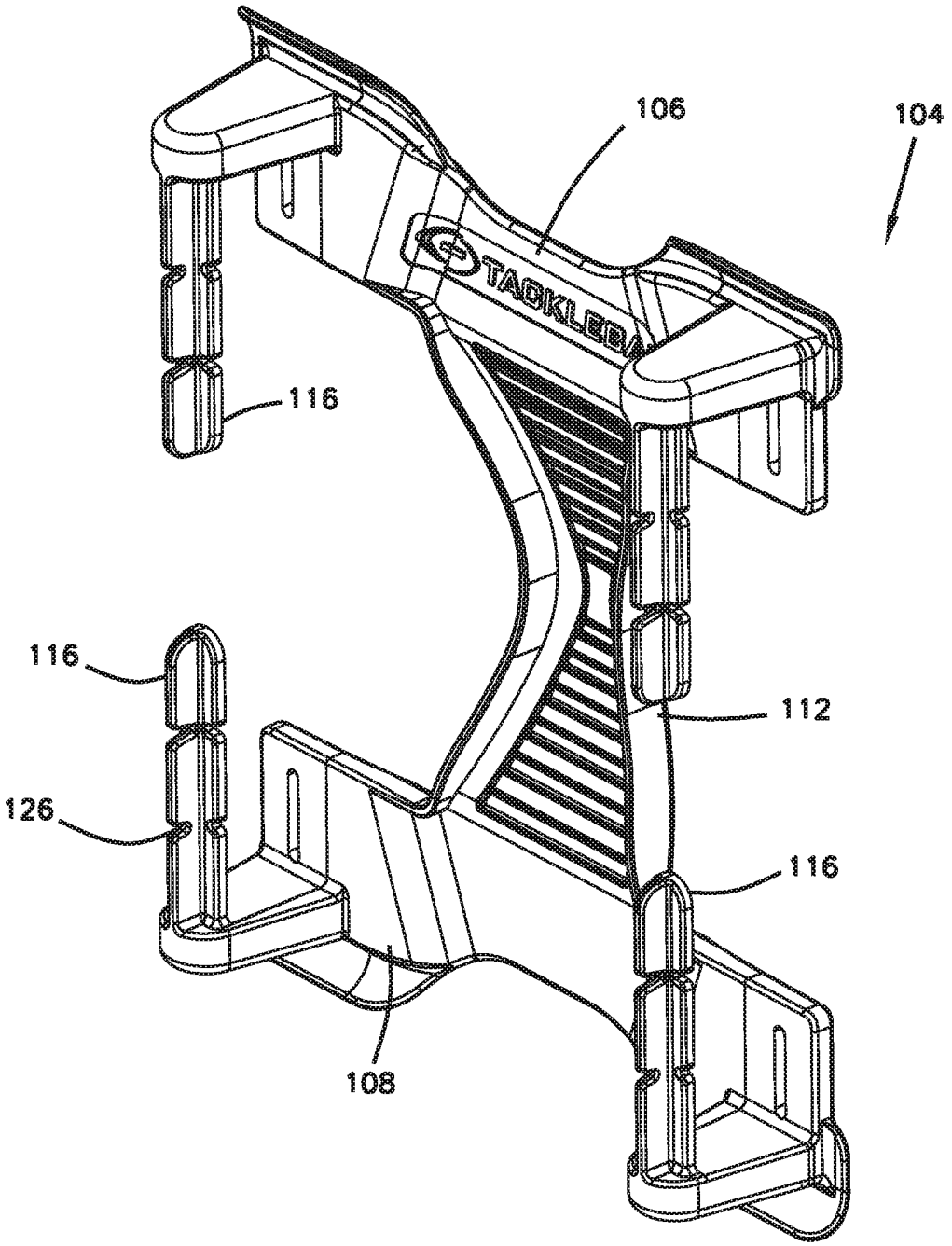
FIG. 16: A rear perspective view of the inventive frame of the harness of FIGS. 12-15, shown in isolation without the straps.
Figure 18:
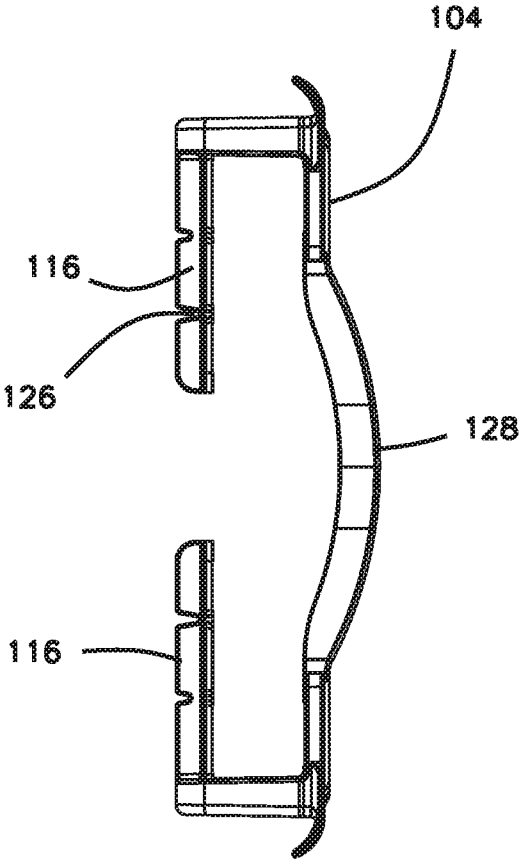
FIG. 18: A side view of the frame of FIG. 16.
Figure 17:
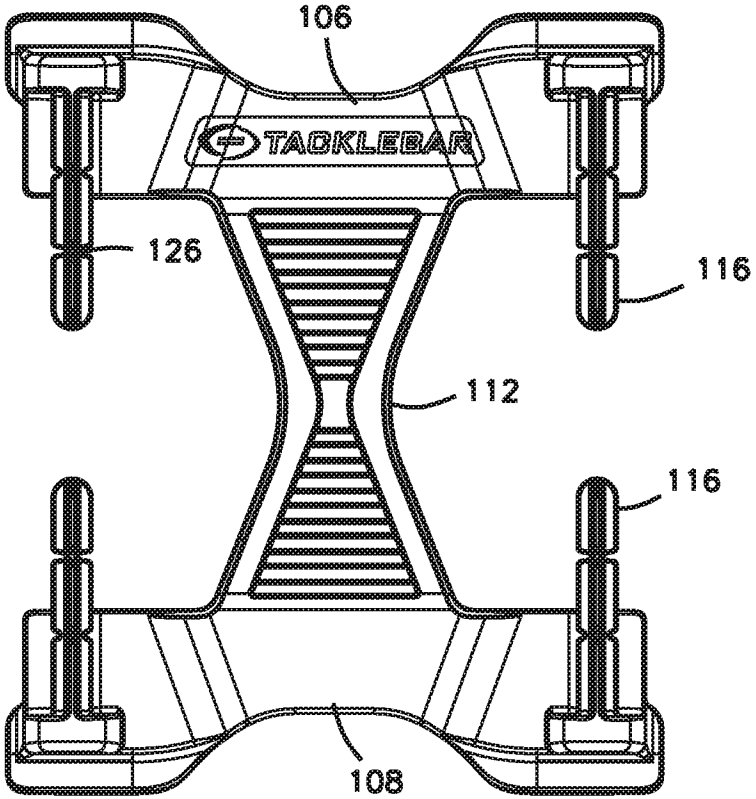
FIG. 17: A rear view of the frame of FIG. 16.

In the depicted harness 102, a frame 104 defined by the harness 102 is positioned against a player's lower back region. The frame 104 defines an upper portion 106, a lower portion 108, and a center portion 112 connecting the upper portion 106 to the lower portion 108. As shown, the frame 104 defines opposingly positioned attachment provisions 114 at each of the upper and lower portions 106, 108 that allow one or more tackling bars 610 to be releasably attached thereto. As shown, according to one embodiment, the attachment provisions 114 are defined by a pair of posts 116 that extend downwardly from the upper portion 106 toward a pair of generally vertically aligned posts 116 that extend upwardly from the lower portion 108 of the frame 104. As shown in the cross-sectional view of FIG. 9A, the posts 116 are configured to be received by opposing ends 118, 120 of a version of the tackling bar 610 that defines a hollow body 122 with a throughhole 124. When mounted as such, a player has full access to the entire length of the bars 610 for removal since the posts 116 are positioned within the bars' hollow bodies 122.

The posts 116 are generally formed from the same material as the rest of the frame 104, such as conformable foam or polymer type materials, so as to allow a certain amount of flexing or bending during placement of the tackling bars 610 on the frame 104. As shown, each post 116 may define partial notches or slits 126 for allowing bending at such points. It should be noted that the specific construction of the posts 116 can provide a certain amount of adjustment or "tuning" to the removal force that is required to remove the tackling bars 610 from the frame 104. Such tuning may be provided by the thickness of the posts 116, the length of the posts 116 as they extend from the frame 104, the flexibility of the material of the posts 116, the location and the density of the notches 126, the material and/or flexibility of the tackling bars 610 themselves, the relative difference between the outer dimensions of the posts 116 and the inner dimensions of the throughholes 124 of the tackling bars 610, and other factors that can vary the amount force needed to remove the bars 610 from the frame 104. Such tuning or variability can make the systems 100 of the present disclosure adaptable to different games, different skill levels, different age levels, different training aspects, and such. As noted previously, the tackling bars 610 may be made from a soft material, such as foam, rubber, silicone, or the like. A soft, compliable material ensures that the tackling bar 610 will not cause pain or injury if a player falls or lands on the tackling bar 610. As noted above, the flexibility provided by the material of the tackling bar 610 itself can be used for "tuning" the removal force needed.

Although the attachment provisions 114 are depicted as opposing posts 116, it should be noted that other types of opposingly provided attachment means 114 may be used such as concave cups or rings that are used in fixing the tackling bars 610 to the frame 104, where such structures may cooperate with the outer dimensions of the tackling bars 610 in fixing the bars 610. However, such outer fixation structures may limit the full-length access provided by "internal" attachment structures such as posts 116 that are inserted into the hollow bodies 122 of the bars 610.

As noted above, FIG. 9A illustrates a cross-sectional view of the attachment between the frame 104 and one of the bars 610 with opposing posts 116 of the frame 104 having been inserted into the opposing ends 118, 120 of the bar 610, locating the bar 610 between the upper and lower portions 106, 108 of the frame 104.

As shown in FIGS. 6-8, 12, 15, and 18, similar to the frame 50 illustrated in FIGS. 4-5, the frame 104 may include a lumbar curve feature 128 that helps position and fit the frame 104 against the lower back region of a player.

As shown and as noted above, when the tackling bars 610 are placed on the frame 104, they are positioned for clear, un-obstructed removal. A cutout 130 is defined in the vicinity of each tackling bar 610 when the tackling bars 610 have been placed on the frame 104. The cutouts 130 are defined at both sides of the center portion 112 of the frame 104 that connects the upper portion 106 to the lower portion 108. As shown, when the tackling bars 610 are attached via the posts 116, posts 116 allow full grip access along the entire length of the tackling bars 610, and the cutouts 130 facilitate full grip removal.

The harness 102, shown in isolation in FIGS. 12-18, is attached to the player via at least one strap 132. The at least one strap 132 defines a right half 134 attached to the frame 104 and a left half 136 that is attached to the frame 104, wherein the right and left halves 134, 136 are removably attached to each other via fastening means such as hook and loop type fasteners, as will be discussed in further detail below.

As shown in FIGS. 12-18, the right half 134 of the strap 132 defines strap segments 138 attached to both the upper and lower portions 106, 108 of the frame 104. The right segments 138 converge toward each other to meet at a first center buckle portion 140. The left half 136 of the strap 132 also defines strap segments 142 attached to both the upper and lower portions 106, 108 of the frame 104. The left segments 142 converge toward each other to meet at a second center buckle portion 144 that is configured for removable attachment to the first center buckle portion 140 to form a center buckle structure 146.

Each of the strap segments 138, 142 are attached via slots 148 provided adjacent right and left ends of the upper and lower portions 106, 108 of the frame 104. As shown, the slots 148 are essentially positioned at the corners of the harness. As noted above, the harness 102 is formed such that the upper strap segments and the lower strap segments at each of the right and left side of the frame 104 converge toward each other to form a triangular configuration. The upper and lower strap segments 138 at the right side of the frame 104 are attached to the first center buckle portion 140, and the upper and lower strap segments 142 at the left side of the frame 104 are attached to the second center buckle portion 144 that is configured to be coupled to the first center buckle portion 140 to form the center buckle structure 146.

The first and second buckle portions 140, 144 may be attached together via hook and loop type fasteners as noted above for a quick-release function.

The convergence of the upper and lower strap segments toward each other positions the center buckle structure 146 at a location generally directly across from the lower back of a player when the harness 102 has been placed on the player. The length of each of the upper and lower strap segments 138 at the right side and each of the upper and lower strap segments 142 at the left side as they extend from the frame 104 toward the center buckle structure 146 are adjustable via adjustment structures 150, as shown in FIGS. 12-18. A player can adjust the lengths of the strap segments 138, 142 to provide for a comfortable and proper fit.

The provision of a center buckle structure 146 that is formed from two removably attached portions 140, 144 defines one of the safety releases for the harness 102. If a player is performing a tackle on another player wearing the harness 102, and the harness 102 starts being pulled instead of a tackling bar 610 being removed, the safety release provided by the center buckle structure 146 limits possible injury to the player. It should be noted that a similar safety release can also be provided individually on each of the strap segments 138, 142 that extend from the upper and lower portions 106, 108 of the frame 104 toward the center buckle structure 146. The adjustment structures 150 can also include quick-release provisions for further safety release functionality in addition to the relatively releaseable first and second center buckle portions 140, 144. The quick-release means may be provided by hook and loop type fasteners or other quick-release coupling mechanisms for the strap segments 138, 142.

The strap segments 138, 142 of the harness 102, at least partially, may be formed from stretchable materials for comfort. However, it is preferred that any stretchability provided on the strap segments 138, 142 not interfere with the functionality of the harness 102 in limiting the movement of the tackling bars 610 to that of the harness 102 itself. Thus, in other examples, the strap segments 138, 142 are formed from non-stretchable materials.

As noted above, the frame 104 of the harness 102, for example, may be made of conformable foam or polymer type materials for fit, comfort, and safety. The frame 104 along with the converging strap segments 138, 142 provides reliable and convenient means for controlling placement and location of tackling bar(s) 610, ensuring that players are consistently wearing the tackling bar(s) 610 in the correct location.

Figure 19:
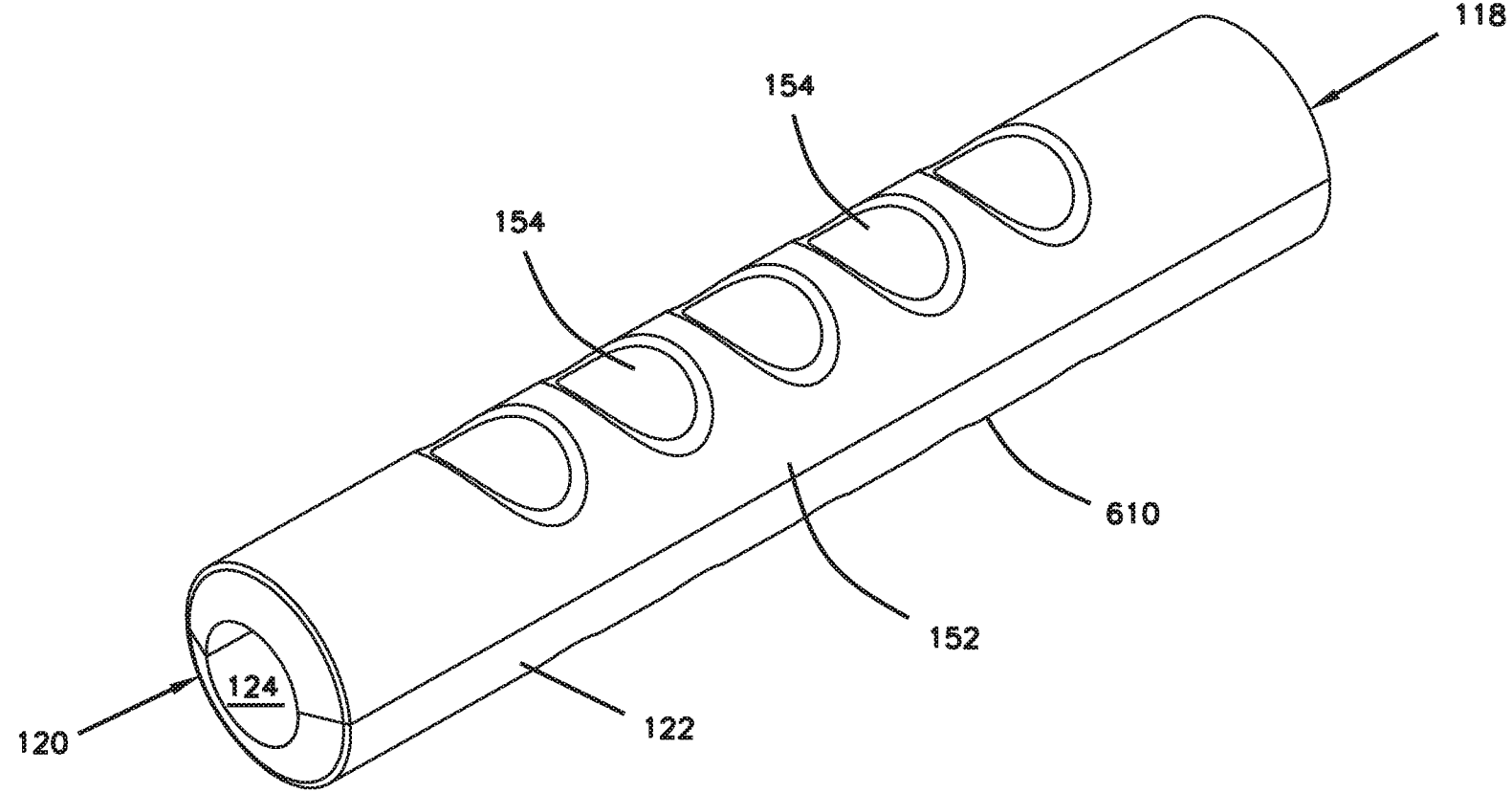
FIG. 19: A rear perspective view of one of the tackling bars of the tackle training system of FIGS. 6-11 shown in isolation, the bar including features that are examples of inventive aspects in accordance with the present disclosure.
Figure 20:
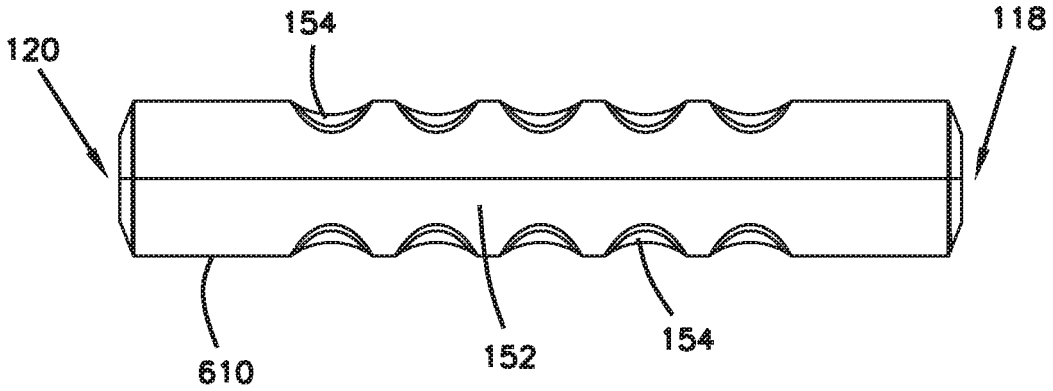
FIG. 20: A side view of the tackling bar of FIG. 19.
Figure 21:
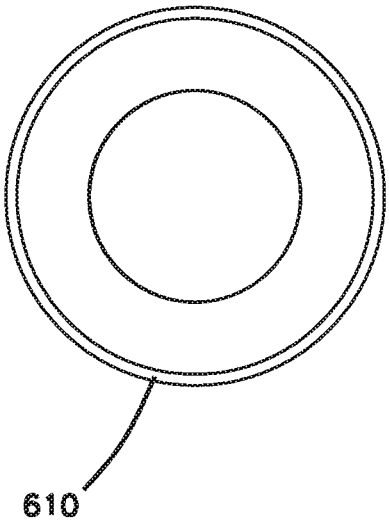
FIG. 21: A top view of the tackling bar of FIG. 19.

FIGS. 19-21 illustrate one of the tackling bars 610 that is configured for use with the system 100 of FIGS. 6-18 of the present disclosure in isolation. The tackling bar 610 is similar in configuration in certain aspects to the bars 10/310/410 shown in FIGS. 2C, 2D, and 3-5. The bar 610 defines an elongated body 122 with opposing ends 118, 120. In the depicted embodiment, the body 122 is defined by a cylindrical configuration, but other shapes are certainly possible.

The length of the bar 610 can vary, but generally the distance between opposing ends 118, 120 of the elongated body 122 should be at least great enough to accommodate a single hand grab during removal. As discussed previously, the elongated body 122 of the bar 610 may function as a handgrip. The body 122 itself may provide appropriate form, size, and shape to be easily and intuitively grasped by a single hand during removal.

As noted above, in other embodiments, the shape of the bar 610 can take on a variety of other forms, such as the rectangular version of the bar 210 illustrated in FIG. 2B. Regardless of the configuration, the various forms, sizes, and shapes of the elongated body 122 should preferably always include a handgrip region 152 appropriately constructed for a single-handed grasp. Furthermore, the bar design 610 should position the handgrip region 152 such that it protrudes from the player, so that it can be easily distinguished during removal.

As shown in FIGS. 19-21, the hand grip region 152 of the tackling bar 610 may even include various features, like finger grips 154 similar to the examples shown in FIGS. 2C, 2D, and 3-5 that further provide distinction and tactile feedback in grabbing the bar 610 during removal.

The body 122 of the version of the tackling bar 610 depicted in isolation in FIGS. 19-21 is generally hollow, with a throughhole 124 extending between the first and second ends 118, 120. Even though the bar 610 has been shown with a throughhole 124 that extends all the way along the length of the bar 610, in other examples, the bar 610 may be provided with partial slots or depressions that are used for receiving the posts 116 of the frame 104 of the system 100 of FIGS. 6-18.

Having described the preferred aspects and embodiments of the present disclosure, modifications and equivalents of the disclosed concepts may readily occur to one skilled in the art. However, it is intended that such modifications and equivalents be included within the scope of the claims which are appended hereto.

The invention claimed is:

1. A tackle training apparatus comprising:

a frame configured to be worn on a player's body, the frame defining an upper portion, a lower portion, and a center portion extending between and connecting the upper portion and the lower portion, wherein the upper, the lower, and the center portions of the frame cooperatively define a generally I-shaped structure, the upper portion defining at least one post extending downwardly toward the lower portion and the lower portion defining at least one post extending upwardly toward the upper portion generally vertically aligned with the at least one post extending from the upper portion, wherein the opposing posts of the upper and lower portions, respectively, are configured for insertion into opposing ends of a bar so as to removably attach and extend the bar between the upper and lower portions of the frame, the posts of the frame configured to limit movement of the removable bar generally to that of the frame, the posts configured to allow release of the removable bar from the frame when a force that overcomes an attachment force provided by the posts is applied to the removable bar, wherein at least one of the post extending toward the upper portion and the post extending toward the lower portion is flexible so as to allow removal of the bar when the force that overcomes the attachment force is applied to the removable bar, the tackle training apparatus further comprising a first strap attached to the upper portion of the frame and a second strap attached to the lower portion of the frame, the first and second straps configured to be used for attaching the tackle training apparatus to the player's body.

2. The apparatus according to claim 1, wherein the frame is formed from a generally rigid polymeric material.

3. The apparatus according to claim 1, wherein both the post extending toward the upper portion and the post extending toward the lower portion are flexible.

4. The apparatus according to claim 1, wherein at least one of the post extending toward the upper portion and the post extending toward the lower portion defines notches along its length for providing flexibility.

5. The apparatus according to claim 1, wherein the posts extending toward the upper and lower portions, respectively, are positioned on the frame such that a cut-out is defined on at least one side of the center portion between the upper portion and the lower portion of the frame, the cut-out for providing access for a player to grab a bar that has been attached to the frame for removal.

6. The apparatus according to claim 1, wherein the at least one post of the upper portion is a pair of posts extending downwardly toward the lower portion, each at opposite sides of the center portion, and the at least one post of the lower portion is a pair of posts extending upwardly toward the upper portion, each at opposite sides of the center portion, wherein the posts extending toward the lower portion are generally vertically aligned with the posts extending toward the upper portion, wherein the opposing posts extending toward the upper and lower portions, respectively, are configured for insertion into opposing ends of at least a pair of bars so as to removably attach and extend the bars between the upper and lower portions of the frame at opposite sides of the center portion.

7. The apparatus according to claim 6, wherein the posts extending toward the upper and lower portions, respectively, are positioned on the frame such that a cut-out is defined on each side of the center portion between the upper portion and the lower portion of the frame, each cut-out for providing access for a player to grab a bar that has been attached to the frame for removal.

8. The apparatus according to claim 1, wherein the center portion of the frame defines a lumbar curve for aiding in positioning and fitting the frame against a player's lower back region.

9. The apparatus according to claim 1, wherein each of the first and second straps defines a right half attached to the frame that is removably attached to a left half attached to the frame.

10. The apparatus according to claim 9, wherein the right half is removably attached to the left half via hook and loop type fasteners.

11. The apparatus according to claim 9, wherein the first and second straps are configured such that the first and second straps cooperatively define a right half that defines strap segments attached to both the upper and lower portions of the frame, the segments converging toward each other to meet at a first center buckle portion, wherein the first and second straps also cooperatively define a left half that defines strap segments attached to both the upper and lower portions of the frame, the segments converging toward each other to meet at a second center buckle portion that is configured for removable attachment to the first center buckle portion to form a center buckle.

12. The apparatus according to claim 11, wherein each strap segment defines a quick-release structure for detachment from a player's body in addition to the relatively releasable first and second center buckle portions.

13. A tackle training system comprising:

a frame configured to be worn on a player's body, the frame defining an upper portion, a lower portion, and a center portion extending between and connecting the upper portion and the lower portion, wherein the upper, the lower, and the center portions of the frame cooperatively define a generally I-shaped structure, the upper portion defining at least one post extending downwardly toward the lower portion and the lower portion defining at least one post extending upwardly toward the upper portion generally vertically aligned with the at least one post extending from the upper portion, wherein the opposing posts of the upper and lower portions, respectively, are configured for insertion into opposing ends of a bar so as to removably attach and extend the bar between the upper and lower portions of the frame, the posts of the frame configured to limit movement of the removable bar generally to that of the frame, the posts configured to allow release of the removable bar from the frame when a force that overcomes an attachment force provided by the posts is applied to the removable bar, wherein at least one of the post of the upper portion and the post of the lower portion is flexible so as to allow removal of the bar when the force that overcomes the attachment force is applied to the removable bar, the tackle training apparatus further comprising a first strap attached to the upper portion of the frame and a second strap attached to the lower portion of the frame, the first and second straps configured to be used for attaching the tackle training apparatus to the player's body; and at least one bar attached to the frame via the posts so as to extend between the upper and lower portions thereof.

14. The tackle training system according to claim 13, wherein both the post extending toward the upper portion and the post extending toward the lower portion are flexible.

15. The tackle training system according to claim 13, wherein at least one of the post extending toward the upper portion and the post extending toward the lower portion defines notches for providing flexibility.

16. The tackle training system according to claim 13, wherein the posts extending toward the upper and lower portions, respectively, are positioned on the frame such that a cut-out is defined on at least one side of the center portion between the upper portion and the lower portion of the frame, the cut-out for providing access for a player to grab the bar that is attached to the frame for removal.

17. The tackle training system according to claim 13, wherein the at least one post of the upper portion is a pair of posts extending downwardly toward the lower portion, each at opposite sides of the center portion, and the at least one post of the lower portion is a pair of posts extending upwardly toward the upper portion, each at opposite sides of the center portion, wherein the posts extending toward the lower portion are generally vertically aligned with the posts extending toward the upper portion, wherein the opposing posts extending toward the upper and lower portions, respectively, are configured for insertion into opposing ends of at least a pair of bars that have been attached to the frame via the posts so as to extend between the upper and lower portions thereof at opposite sides of the center portion.

18. The tackle training system according to claim 17, wherein the posts extending toward the upper and lower portions, respectively, are positioned on the frame such that a cut-out is defined on each side of the center portion between the upper portion and the lower portion of the frame, each cut out for providing access for a player to grab the bars that are attached to the frame for removal.

19. The tackle training system according to claim 13, wherein the center portion of the frame defines a lumbar curve for aiding in positioning and fitting the frame against a player's lower back region.

* * * * *